US010221845B2

(12) United States Patent
Tanaka et al.

(10) Patent No.: US 10,221,845 B2
(45) Date of Patent: Mar. 5, 2019

(54) BLOWER

(71) Applicant: Murata Manufacturing Co., Ltd., Kyoto (JP)

(72) Inventors: Nobuhira Tanaka, Kyoto (JP); Hiroyuki Yokoi, Kyoto (JP); Masahiro Sasaki, Kyoto (JP); Kiyoshi Kurihara, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 60 days.

(21) Appl. No.: 15/258,306

(22) Filed: Sep. 7, 2016

(65) Prior Publication Data

US 2016/0377073 A1 Dec. 29, 2016

Related U.S. Application Data

(63) Continuation of application No. PCT/JP2015/054534, filed on Feb. 19, 2015.

(30) Foreign Application Priority Data

Mar. 7, 2014 (JP) ..... 2014-044941

(51) Int. Cl.
*F04B 45/04* (2006.01)
*F04B 45/047* (2006.01)
(Continued)

(52) U.S. Cl.
CPC ..... *F04B 45/047* (2013.01); *F04B 17/003* (2013.01); *F04B 45/04* (2013.01); *F04B 53/16* (2013.01); *F04B 53/10* (2013.01)

(58) Field of Classification Search
CPC ..... F04B 17/003; F04B 43/09; F04B 43/095; F04B 43/043; F04B 43/046; F04B 45/047;
(Continued)

(56) References Cited

U.S. PATENT DOCUMENTS 4,648,807 A * 3/1987 Tippetts ..... F04B 43/046 417/413.2
4,708,600 A * 11/1987 AbuJudom, II ..... F04B 43/046 310/328
(Continued)

FOREIGN PATENT DOCUMENTS

JP 2006-297295 A 11/2006
JP 4795428 B2 10/2011
(Continued)

OTHER PUBLICATIONS

International Search Report to Application No. PCT/JP2015/054534 dated May 12, 2015.
(Continued)

*Primary Examiner* — Nathan C Zollinger
(74) *Attorney, Agent, or Firm* — Pearne & Gordon LLP

(57) ABSTRACT

A piezoelectric blower (100) includes a housing (17), a vibrating plate (41), and a piezoelectric element (42). The vibrating plate (41) forms a column-shaped blower chamber (31) together with the housing (17). The vibrating plate (41) and the housing (17) are formed so that the blower chamber (31) has a radius a. The piezoelectric element (42) causes the vibrating plate (41) to concentrically bend and vibrate at a resonance frequency f. A recessed portion (26) is formed in the housing (17) on the side facing the vibrating plate (41). The recessed portion (26) defines a cavity (25), which constitutes the blower chamber (31) and communicates with the vent hole (24). The radius a of the blower chamber (31) and the resonance frequency f of the vibrating plate (41) satisfy a relationship of $0.8\times(k_0c)/(2\pi)\leq af\leq 1.2\times(k_0c)/(2\pi)$.

21 Claims, 23 Drawing Sheets

(51) Int. Cl.
*F04B 53/10* (2006.01)
*F04B 53/16* (2006.01)
*F04B 17/00* (2006.01)

(58) Field of Classification Search
CPC ..... F04B 45/04; F04B 49/225; F04B 53/10; F04B 53/16; F04F 7/00
See application file for complete search history.

(56) References Cited

U.S. PATENT DOCUMENTS 6,179,586 B1 * 1/2001 Herb ..... F04B 43/043 417/322
7,498,718 B2 * 3/2009 Vogeley ..... F04B 43/046 310/324
7,793,709 B2 * 9/2010 Mukasa ..... H02K 33/18 165/121
8,123,502 B2 * 2/2012 Blakey ..... F04B 43/046 417/413.1
8,721,303 B2 * 5/2014 Fujisaki ..... F04B 43/095 417/413.2
9,127,665 B2 * 9/2015 Locke ..... F04B 43/023
9,506,463 B2 * 11/2016 Locke ..... F04B 43/046
9,714,651 B2 * 7/2017 Hirata ..... F04B 43/04
2006/0237171 A1 10/2006 Mukasa et al.
2009/0087323 A1 4/2009 Blakey et al.
2011/0190670 A1 8/2011 Jaeb et al.
2013/0071273 A1 * 3/2013 Locke ..... F04B 43/046 417/480
2013/0236338 A1 * 9/2013 Locke ..... F04B 43/023 417/413.1
2014/0010673 A1 1/2014 Locke et al.
2014/0050604 A1 * 2/2014 Campbell ..... F04B 19/006 417/413.2
2017/0002839 A1 * 1/2017 Bukland ..... F04B 43/046
2018/0100495 A1 * 4/2018 Tanaka ..... F04B 43/02

FOREIGN PATENT DOCUMENTS

JP 2012-528980 A 11/2012
JP 2012-528981 A 11/2012
JP 2013-532246 A 8/2013

OTHER PUBLICATIONS

Written Opinion of the International Searching Authority for Application No. PCT/JP2015/054534 dated May 12, 2015.
Japanese Office Action for Application No. 2016-506418 dated Jul. 26, 2016.

* cited by examiner

BLOWER

This is a continuation of International Application No. PCT/JP2015/054534 filed on Feb. 19, 2015 which claims priority from Japanese Patent Application No. 2014-044941 filed on Mar. 7, 2014. The contents of these applications are incorporated herein by reference in their entireties.

BACKGROUND OF THE DISCLOSURE

Field of the Disclosure

The present disclosure relates to a blower that transports gas.

Description of the Related Art

Various types of blowers that transport gas are known to date. For example, Patent Document 1 discloses a piezoelectric-driven pump.

This pump includes a piezoelectric disc, a circular plate to which the piezoelectric disc is joined, and a body that defines a cavity together with the circular plate. The body has an inlet through which gas flows in and an outlet through which the gas flows out. The inlet is disposed between a central axis of the cavity and an outer periphery of the cavity. The outlet is disposed at the central axis of the cavity. The outlet is provided with a valve that prevents gas from flowing into the cavity from the outside of the cavity.

When in active, this pump causes the circular plate to bend and vibrate using the piezoelectric disc. Thus, gas flows into the cavity through the inlet and gas in the cavity is ejected through the outlet.

Patent Document 1: Japanese Patent No. 4795428

BRIEF SUMMARY OF THE DISCLOSURE

However, when the pump described in Patent Document 1 is in active, gas flowing at a high speed flows out through the outlet or flows into the cavity through the outlet. Particularly, since the pump described in Patent Document 1 includes a valve, opening or closing of the valve causes nonlinear pressure changes in the cavity.

A swirl thus occurs near the outlet of the cavity. This swirl disturbs pressure vibration in the cavity and reduces the pressure amplitude in the cavity.

Thus, the pump described in Patent Document 1 is disadvantageous in that a swirl that occurs near the outlet of the cavity (blower chamber) reduces the discharge pressure and hinders an achievement of high discharge pressure.

The present disclosure aims to provide a blower that can weaken a swirl that occurs near the outlet of a blower chamber so that reduction of the discharge pressure can be minimized.

A blower according to the present disclosure has the following configuration for the purpose of solving the above-described problem.

A blower according to the present disclosure includes an actuator and a housing. The actuator includes a vibrating plate and a driving member. The vibrating plate has a first principal surface and a second principal surface. The driving member is disposed on at least one of the first principal surface and the second principal surface of the vibrating plate. The driving member causes the vibrating plate to concentrically bend and vibrate.

The housing is joined to the vibrating plate and defines a blower chamber together with the actuator. At least one of the vibrating plate and the housing includes a vent hole and a recessed portion. The vent hole connects a central portion of the blower chamber to the outside of the blower chamber. The recessed portion constitutes the blower chamber and defines a communication space that communicates with the vent hole. The communication space constitutes the blower chamber.

When a space interposed between the vibrating plate and the housing is in contact with an opening having an opening ratio of 50% or higher, this blower chamber refers to a part of the space located further inward from the opening when the first principal surface of the vibrating plate is viewed from the front, whereas when the space interposed between the vibrating plate and the housing is not in contact with an opening having an opening ratio of 50% or higher, this blower chamber refers to the space interposed between the vibrating plate and the housing.

The opening ratio is defined as the ratio of how much the space interposed between the vibrating plate and the housing communicates with the outside of a joined body, in which the vibrating plate and the housing are joined. The opening that connects the space interposed between the vibrating plate and the housing to the outside is formed in either the vibrating plate or the housing, or both.

A shortest distance a from a central axis of the blower chamber to the outer periphery of the blower chamber and a resonance frequency f of the vibrating plate satisfy a relationship of $0.8\times(k_0c)/(2\pi)\leq af\leq 1.2\times(k_0c)/(2\pi)$, where an acoustic velocity of gas that passes through the blower chamber is denoted by c and a value that satisfies a relationship of a Bessel function of a first kind of $J_0(k_0)=0$ or $J_0'(k_0)=0$ is denoted by $k_0$.

In this configuration, the vibrating plate and the housing are formed so as to have the shortest distance a. The driving member vibrates the vibrating plate at the resonance frequency f. The resonance frequency f of the vibrating plate is determined by, for example, the thickness of the vibrating plate and the material of the vibrating plate.

When the space interposed between the vibrating plate and the housing is in contact with the opening having an opening ratio of 50% or higher, a value that satisfies the relationship of the Bessel function of the first kind of $J_0(k_0)=0$ is determined as $k_0$. When the space interposed between the vibrating plate and the housing is not in contact with the opening having an opening ratio of 50% or higher, a value that satisfies the relationship obtained by differentiation of the Bessel function of the first kind of $J_0'(k_0)=0$ is determined as $k_0$.

When the space interposed between the vibrating plate and the housing is in contact with the opening having an opening ratio of 50% or higher, a shortest distance from a central axis of the vibrating plate to an end of an area of the vibrating plate, the area being located further inward from the opening when the first principal surface is viewed from the front, is determined as the shortest distance a. When the space interposed between the vibrating plate and the housing is not in contact with the opening having an opening ratio of 50% or higher, a shortest distance from a central axis of the vibrating plate to an end of an area of the vibrating plate located further inward from a joint portion at which the vibrating plate is joined to the housing, is determined as the shortest distance a.

Here, when $af=(k_0c)/(2\pi)$, an outermost node among nodes of vibration of the vibrating plate coincides with a node of pressure vibration of the blower chamber, and pressure resonance occurs. Further, even when the relationship of $0.8\times(k_0c)/(2\pi)\leq af\leq 1.2\times(k_0c)/(2\pi)$ is satisfied, the outermost node among the nodes of vibration of the vibrating plate substantially coincides with the node of pressure vibration of the blower chamber.

Thus, when the relationship of $0.8\times(k_0c)/(2\pi)\leq af\leq 1.2\times(k_0c)/(2\pi)$ is satisfied, the blower having this configuration can produce high discharge pressure and high discharge flow rate.

The blower having this configuration includes a communication space near the vent hole of the blower chamber. Thus, a swirl that occurs near the vent hole of the blower chamber is weakened in the communication space. This configuration is thus capable of preventing pressure vibration in the blower chamber from being disturbed by the swirl.

The blower having this configuration is thus capable of weakening a swirl occurring near the vent hole of the blower chamber and minimizing reduction of discharge pressure.

It is further desirable that the shortest distance a and the resonance frequency f satisfy the relationship of $0.9\times(k_0c)/(2\pi)\leq af\leq 1.1\times(k_0c)/(2\pi)$.

It is desirable that the vent hole of the housing be provided with a valve that prevents gas from flowing into the blower chamber from the outside of the blower chamber.

In the case where a valve is disposed at the vent hole of the housing, nonlinear pressure change occurs in the blower chamber as a result of opening or closing of the valve. Thus, a swirl is more likely to occur near the vent hole of the blower chamber. Thus, the communication space is particularly effective in the blower having this configuration including the valve.

It is desirable that, in a range from the central axis of the vibrating plate to the outer periphery of the blower chamber, the number of zero crossover points of vibration displacement of the vibrating plate coincide with the number of zero crossover points of pressure change of the blower chamber. Here, each point on the vibrating plate within an area from the central axis of the blower chamber to the outer periphery of the blower chamber is displaced by vibration. In addition, from the central axis of the vibrating plate to the outer periphery of the blower chamber, the pressure at each point in the blower chamber changes due to the vibrating plate being vibrated.

In this configuration, when the vibrating plate vibrates, the distribution of the displacements of the respective points on the vibrating plate approximates to the distribution of the pressure changes at the respective points in the blower chamber. In other words, when the vibrating plate vibrates, the points on the vibrating plate are displaced in accordance with the pressure changes at the respective points in the blower chamber.

Thus, the blower having this configuration is capable of transmitting vibration energy of the vibrating plate to the gas in the blower chamber without losing most of the vibration energy. Thus, the blower having this configuration can produce high discharge pressure and high discharge flow rate.

A pressure change distribution u(r) of the points in the blower chamber is expressed by the formula $u(r)=J_0(k_0r/a)$, where the distance from the central axis of the vibrating plate is denoted by r.

It is desirable that the driving member be a piezoelectric element.

The present disclosure is capable of weakening a swirl occurring near an outlet of a blower chamber and minimizing reduction of discharge pressure.

Figure 1:
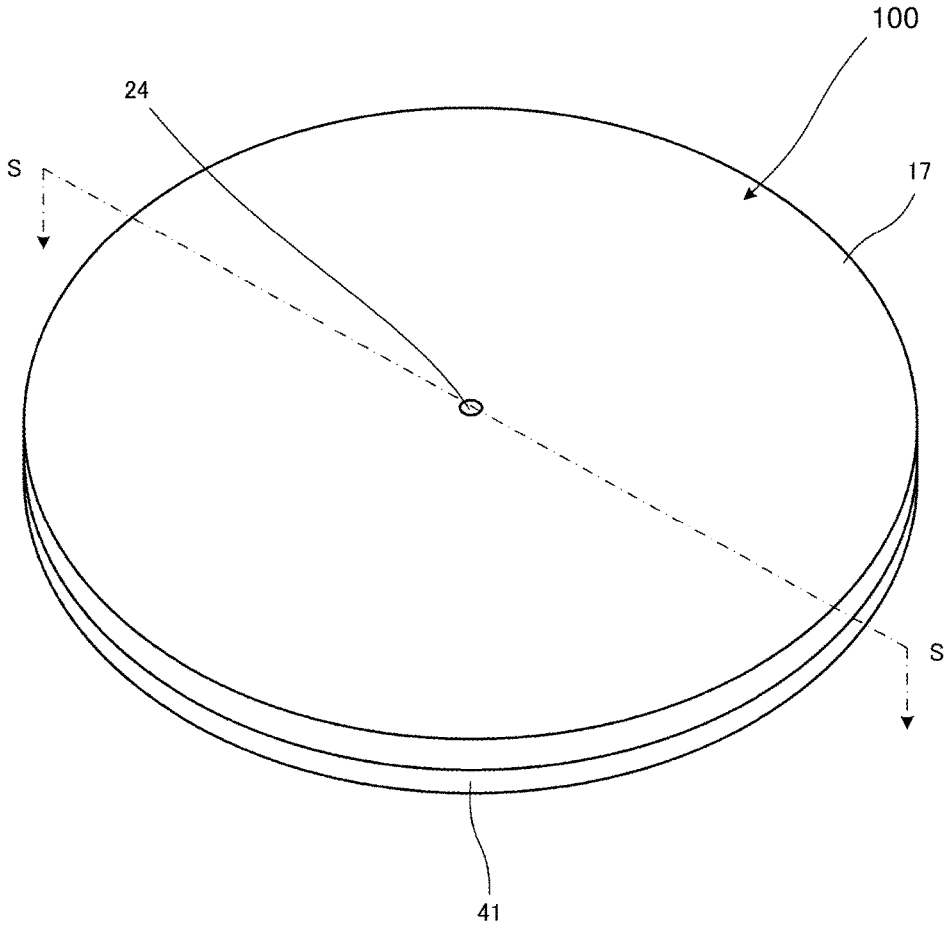
FIG. 1 is an external perspective view of a piezoelectric blower 100 according to a first embodiment of the present disclosure.
Figure 4A:
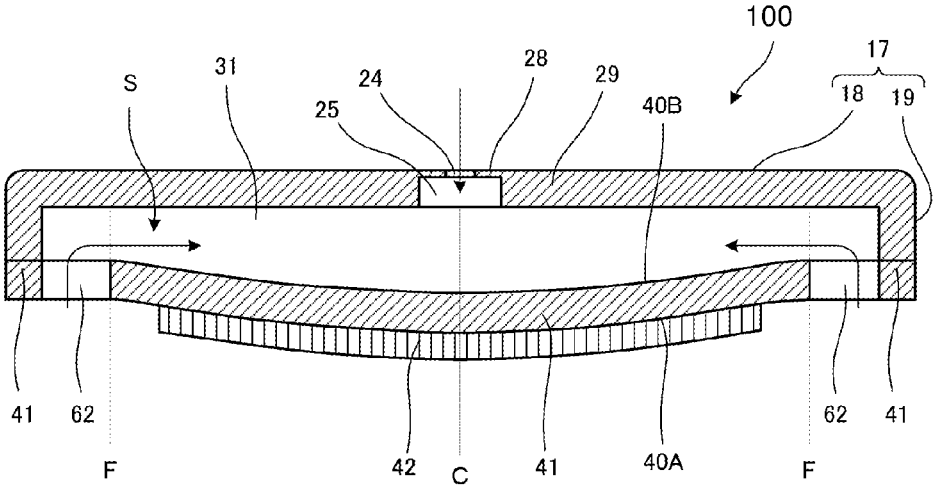
Figure 4B:
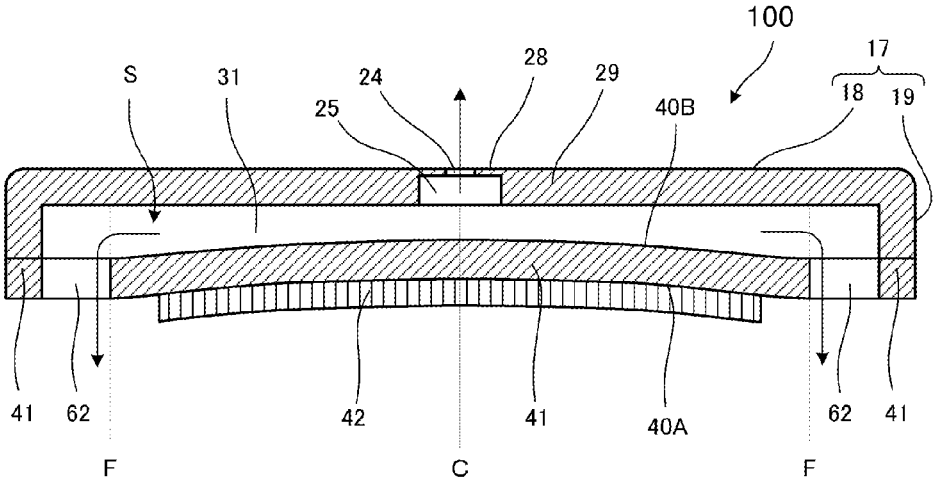

Each of FIGS. 4A and 4B is a cross-sectional view of the piezoelectric blower 100 illustrated in FIG. 1 taken along line S-S when the piezoelectric blower 100 is operated at a first-order mode resonance frequency (fundamental).

Figure 5:
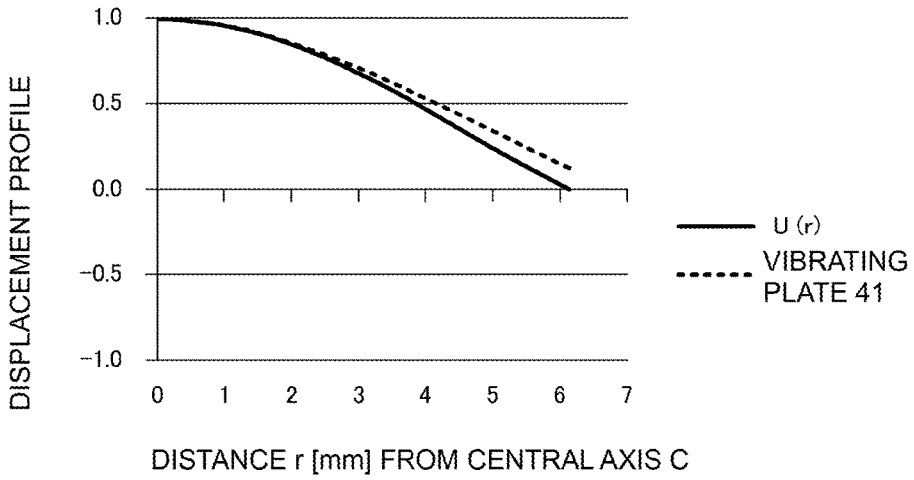

FIG. 5 shows the relationship between pressure change at each point in a blower chamber 31 and displacement at each point of a vibrating plate 41 in the piezoelectric blower 100 illustrated in FIG. 1.

Figure 6:
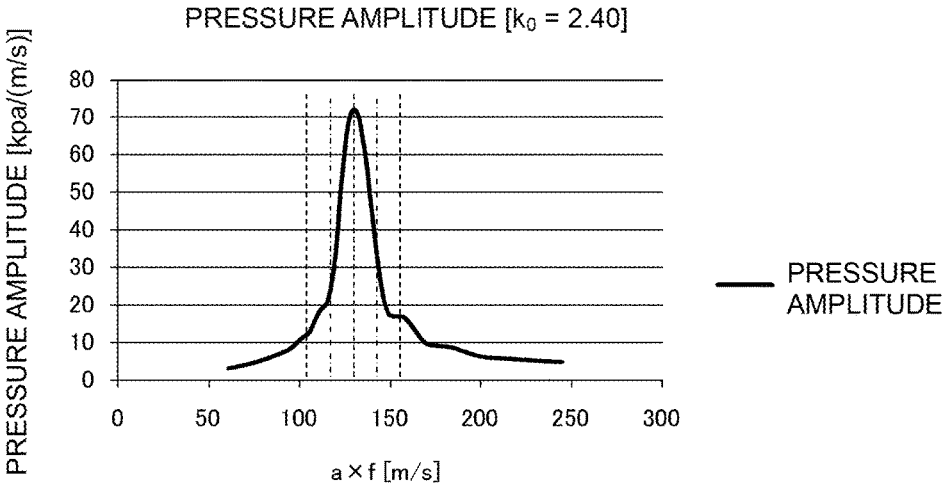

FIG. 6 shows the relationship between a radius a multiplied by a resonance frequency f and pressure amplitude in the piezoelectric blower 100 illustrated in FIG. 1.

Figure 7:
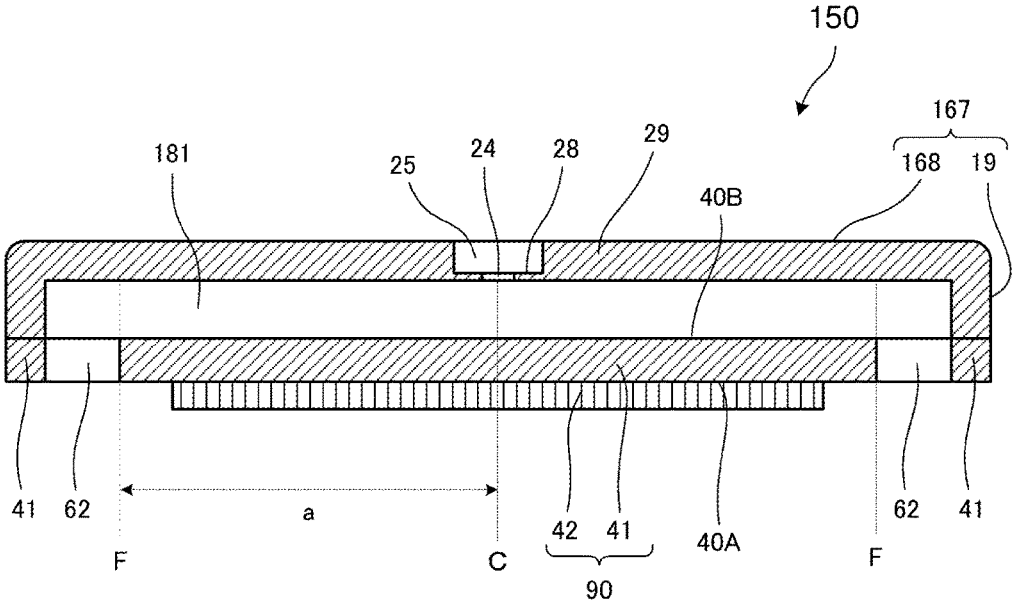

FIG. 7 is a cross-sectional view of a piezoelectric blower 150 according to a comparative example provided for comparison with the first embodiment of the present disclosure.

Figure 8:
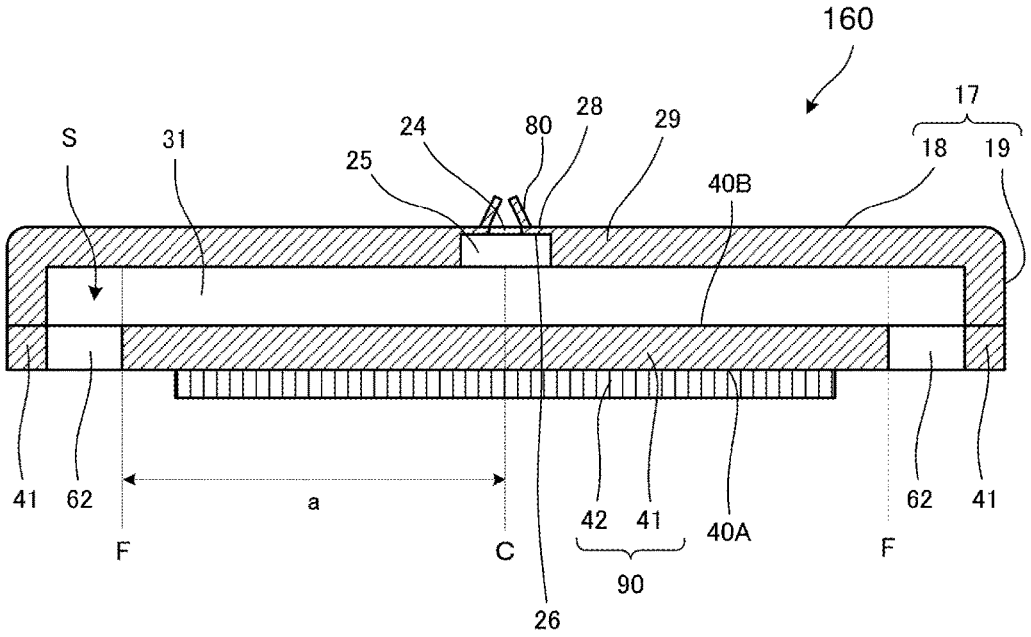

FIG. 8 is a cross-sectional view of a piezoelectric blower 160 according to a modified example of the first embodiment of the present disclosure.

Figure 9:
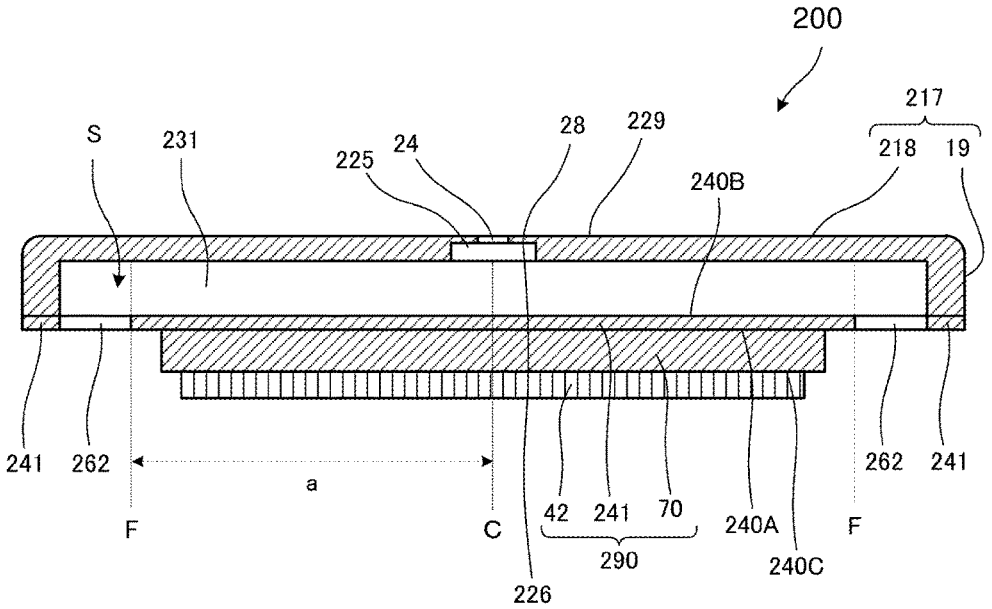

FIG. 9 is a cross-sectional view of a piezoelectric blower 200 according to a second embodiment of the present disclosure.

Figure 10:
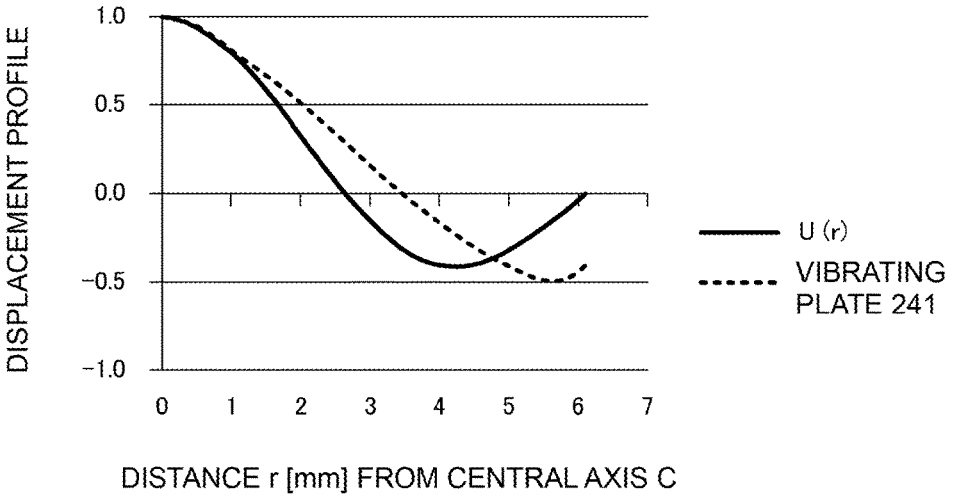

FIG. 10 shows the relationship between pressure change at each point of a blower chamber 231 of the piezoelectric blower 200 illustrated in FIG. 9 and displacement at each point of a vibrating plate 241 of the piezoelectric blower 200.

Figure 11:
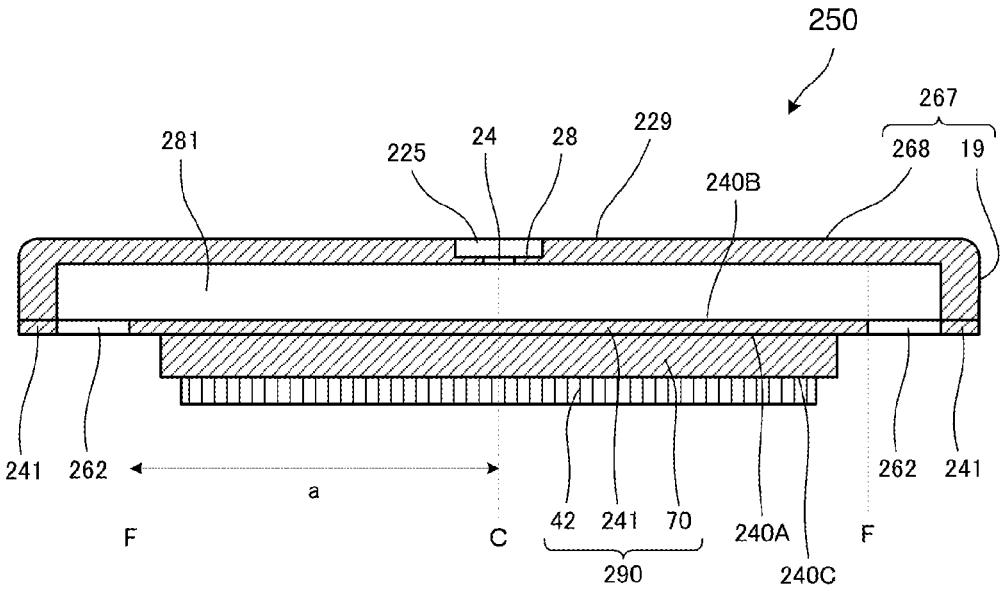

FIG. 11 is a cross-sectional view of a piezoelectric blower 250 according to a comparative example provided for comparison with the second embodiment of the present disclosure.

Figure 12:
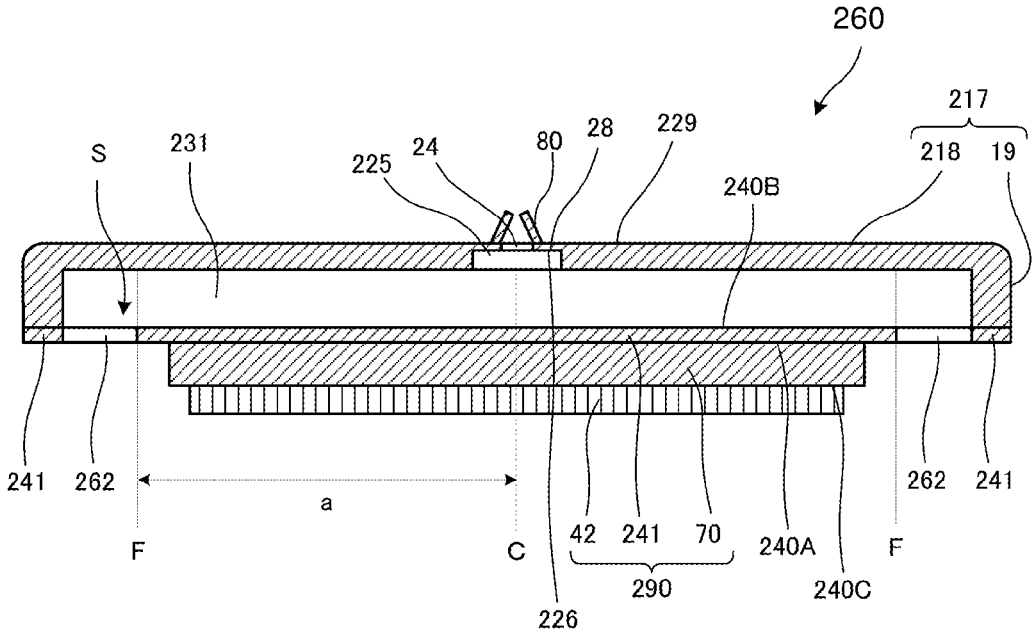

FIG. 12 is a cross-sectional view of a piezoelectric blower 260 according to a modified example of the second embodiment of the present disclosure.

Figure 13:
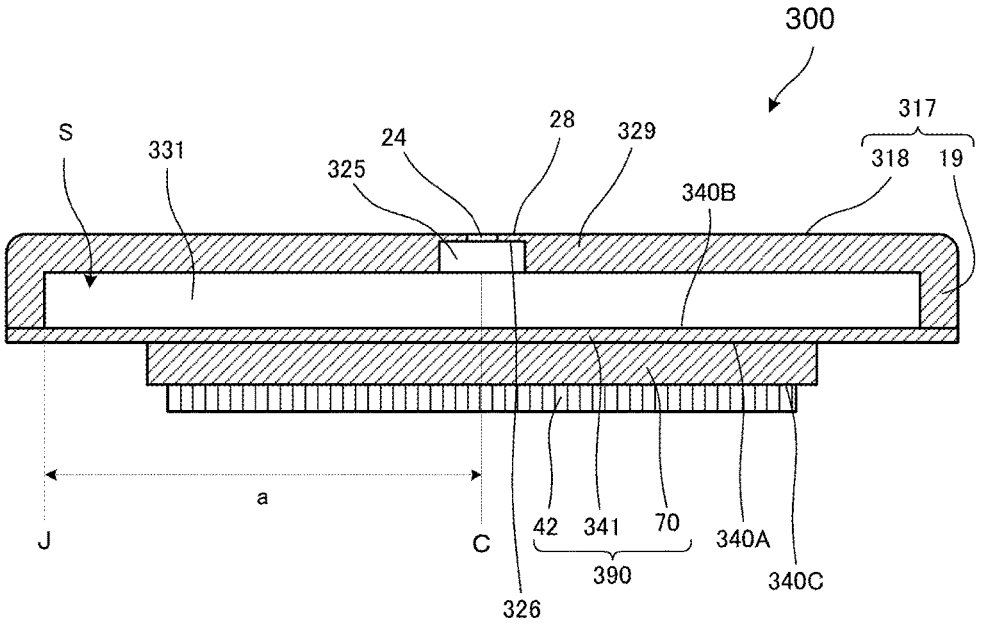

FIG. 13 is a cross-sectional view of a piezoelectric blower 300 according to a third embodiment of the present disclosure.

Figure 14:
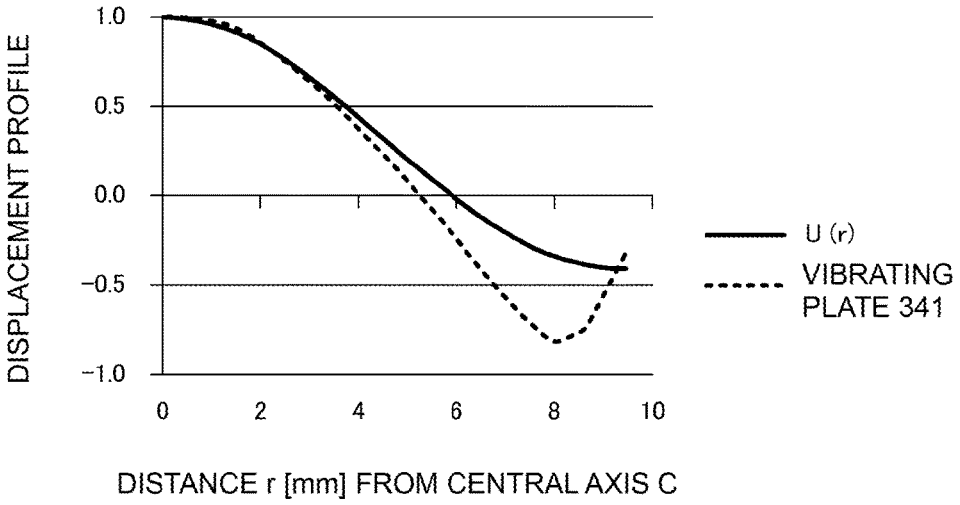

FIG. 14 shows the relationship between pressure change at each point of a blower chamber 331 of the piezoelectric blower 300 illustrated in FIG. 13 and displacement at each point of a vibrating plate 341 of the piezoelectric blower 300.

Figure 15:
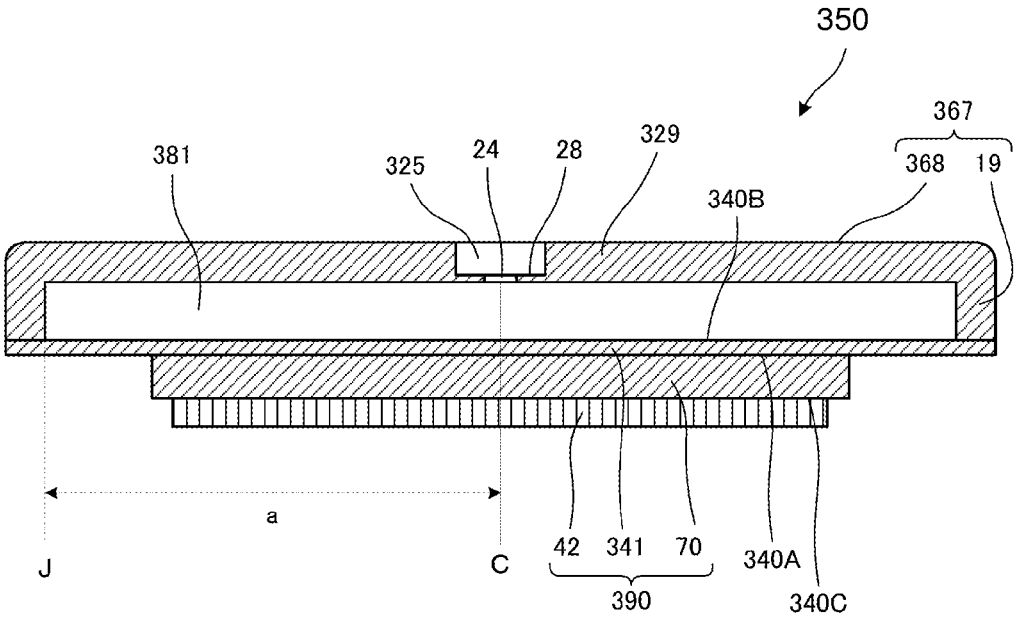

FIG. 15 is a cross-sectional view of a piezoelectric blower 350 according to a comparative example provided for comparison with the third embodiment of the present disclosure.

Figure 16:
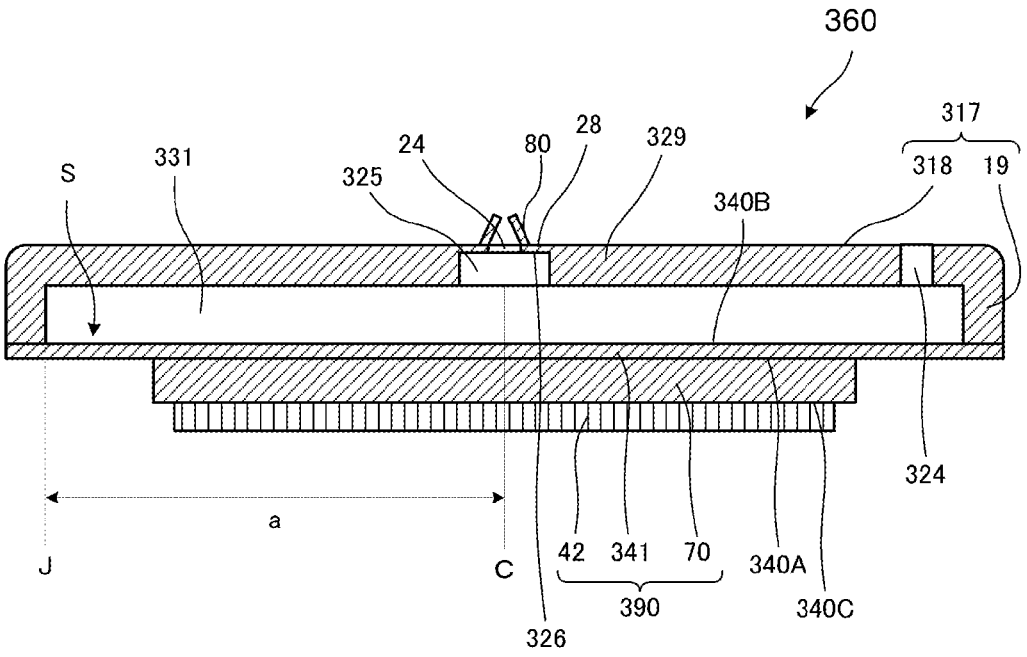

FIG. 16 is a cross-sectional view of a piezoelectric blower 360 according to a modified example of the third embodiment of the present disclosure.

Figure 17:
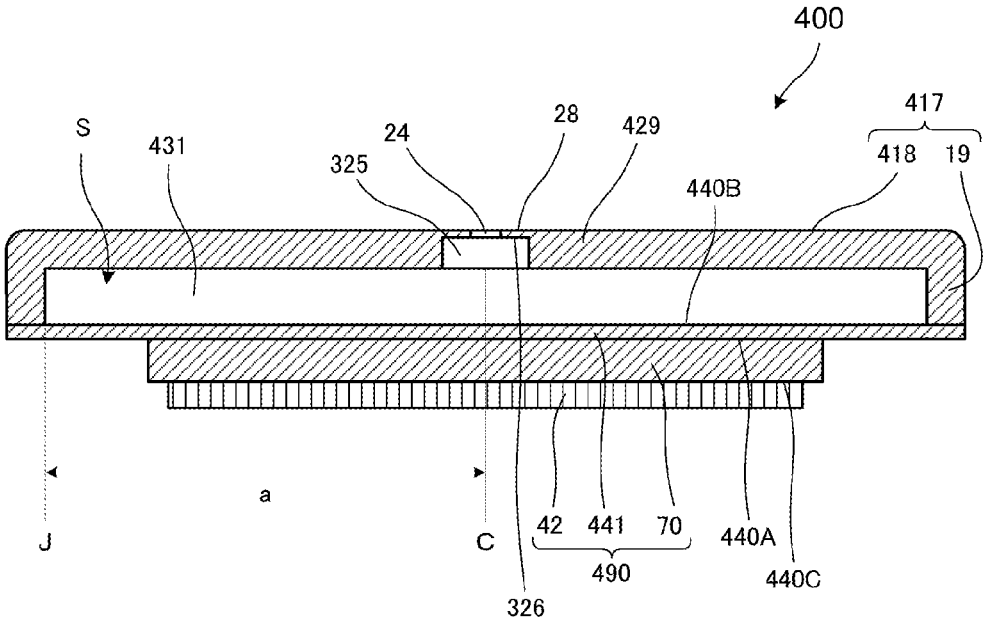

FIG. 17 is a cross-sectional view of a piezoelectric blower 400 according to a fourth embodiment of the present disclosure.

Figure 18:
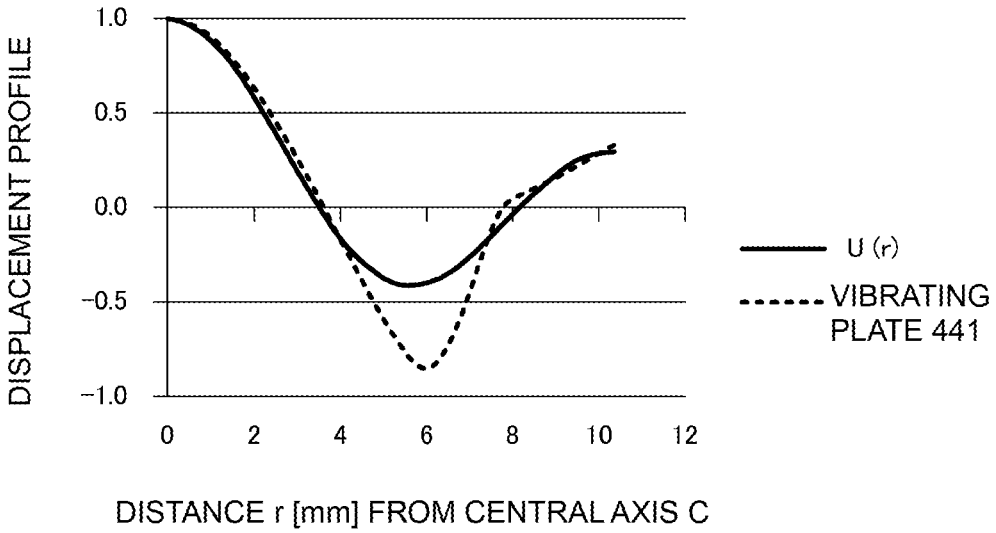

FIG. 18 shows the relationship between pressure change at each point of a blower chamber 431 of the piezoelectric blower 400 illustrated in FIG. 17 and displacement at each point of a vibrating plate 441 of the piezoelectric blower 400.

Figure 19:
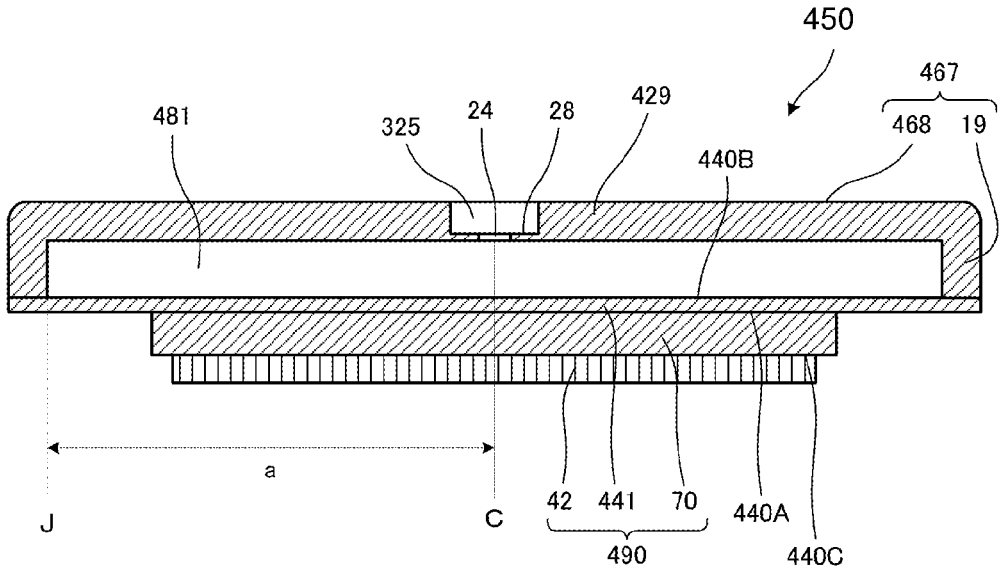

FIG. 19 is a cross-sectional view of a piezoelectric blower 450 according to a comparative example provided for comparison with the fourth embodiment of the present disclosure.

Figure 20:
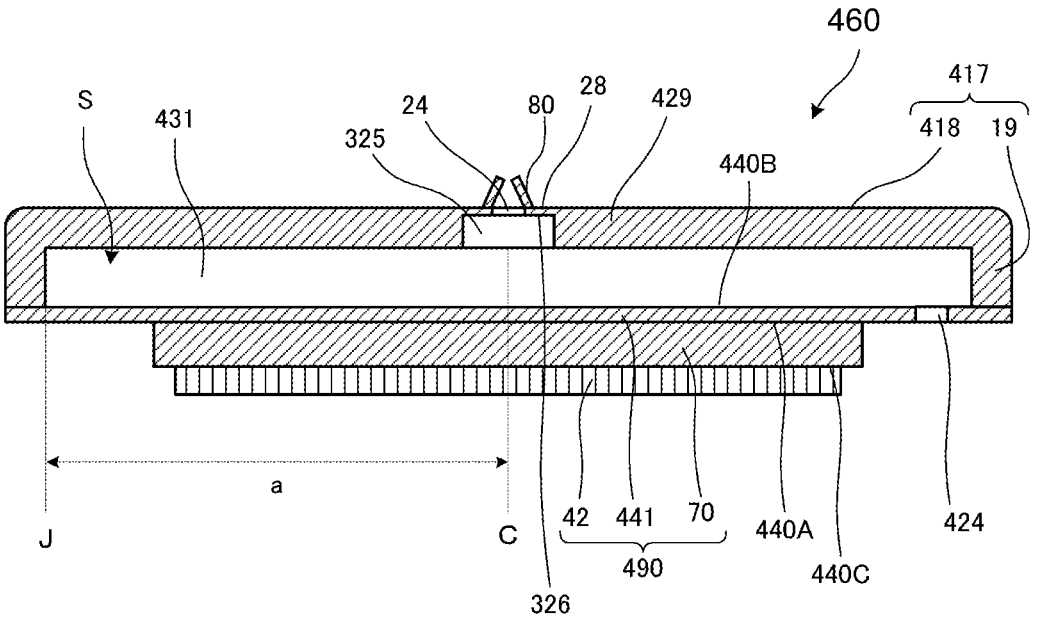

FIG. 20 is a cross-sectional view of a piezoelectric blower 460 according to a modified example of the fourth embodiment of the present disclosure.

Figure 21:
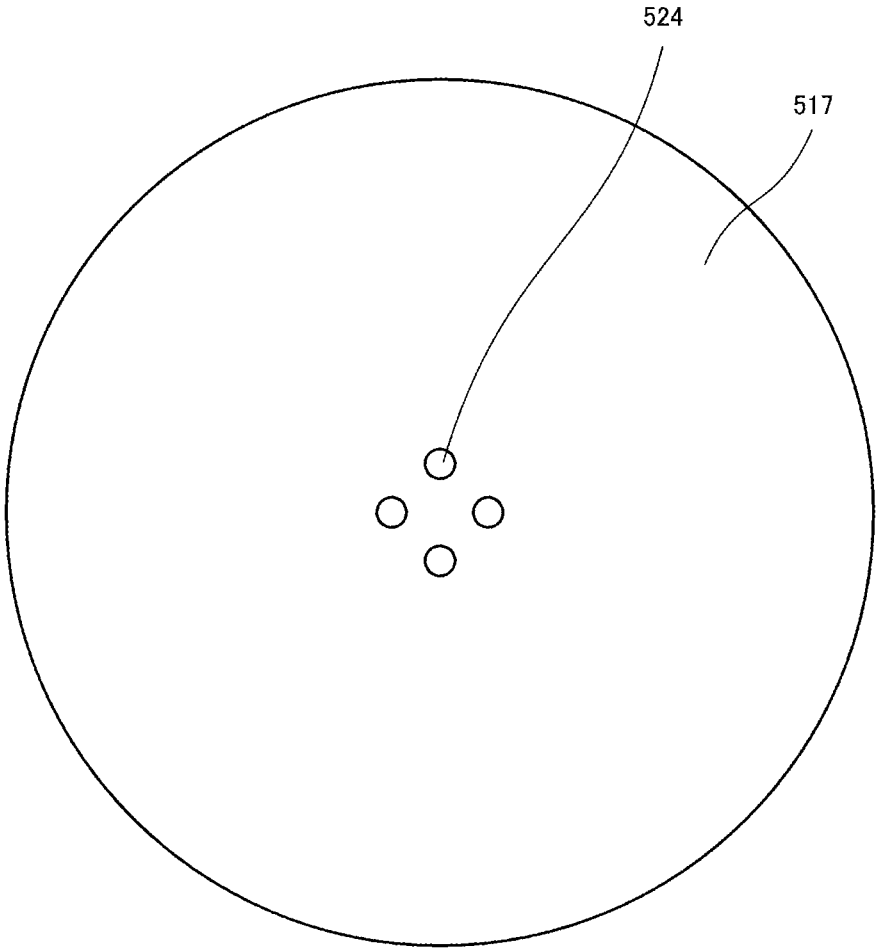

FIG. 21 is a plan view of a housing 517 according to a first modified example, obtained by modifying a housing 17 illustrated in FIG. 1.

Figure 22:
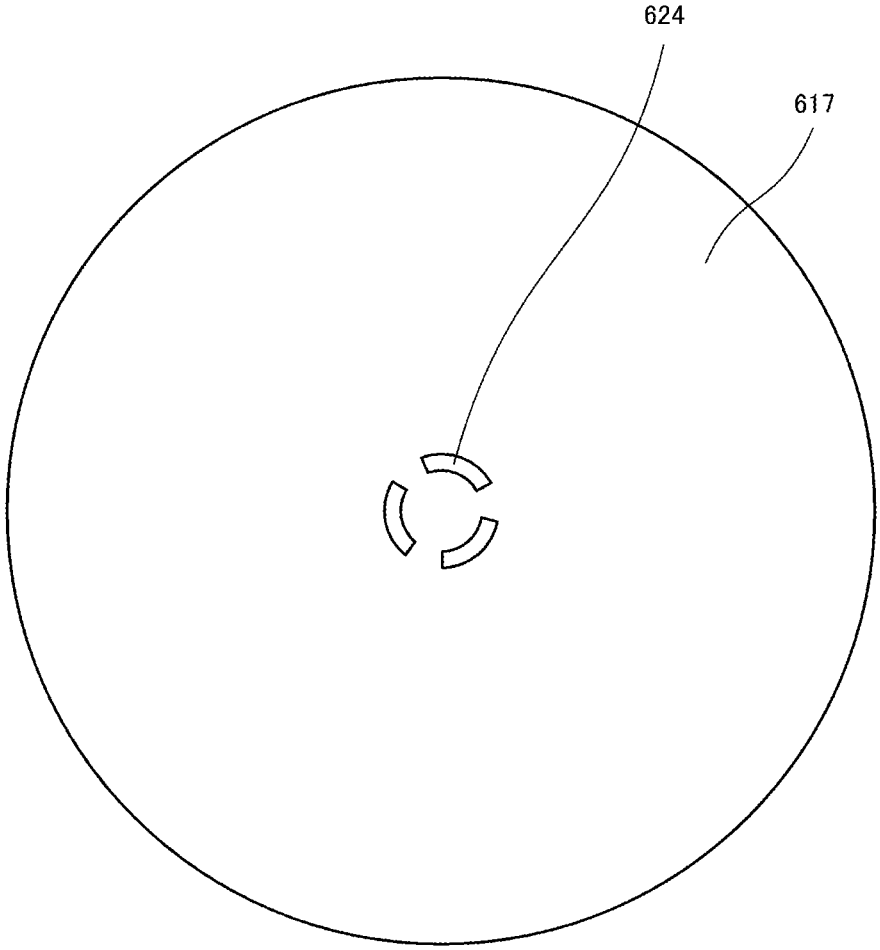

FIG. 22 is a plan view of a housing 617 according to a second modified example, obtained by modifying the housing 17 illustrated in FIG. 1.

Figure 23:
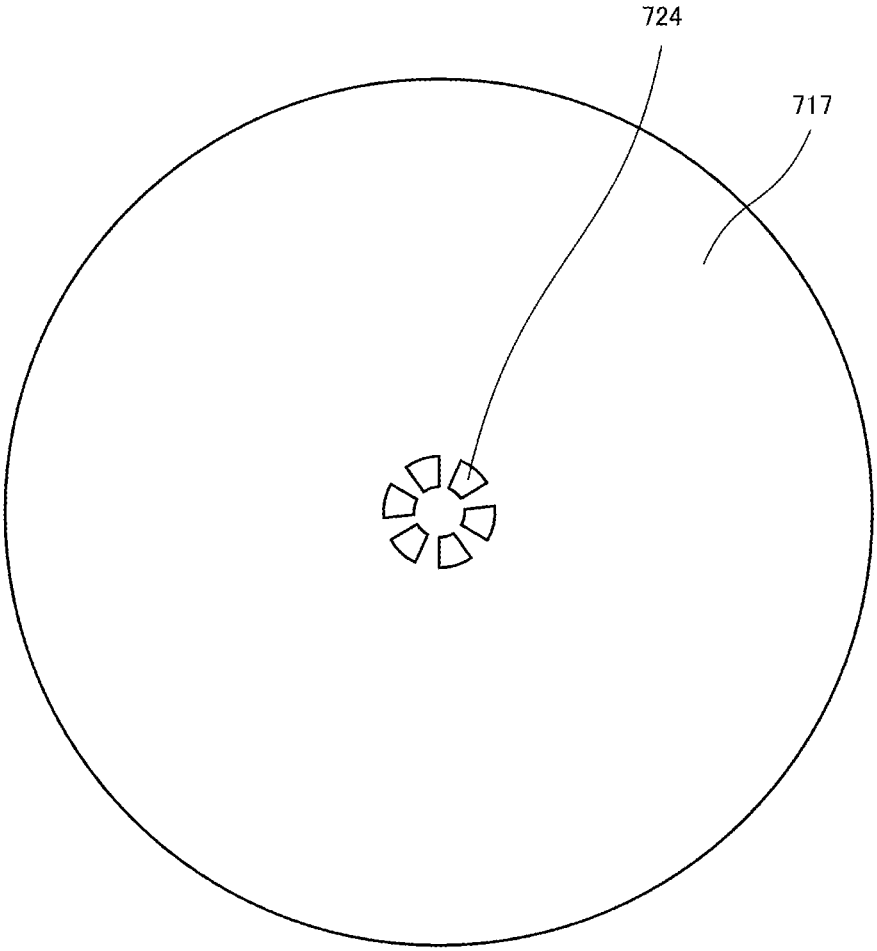

FIG. 23 is a plan view of a housing 717 according to a third modified example, obtained by modifying the housing 17 illustrated in FIG. 1.

Figure 24:
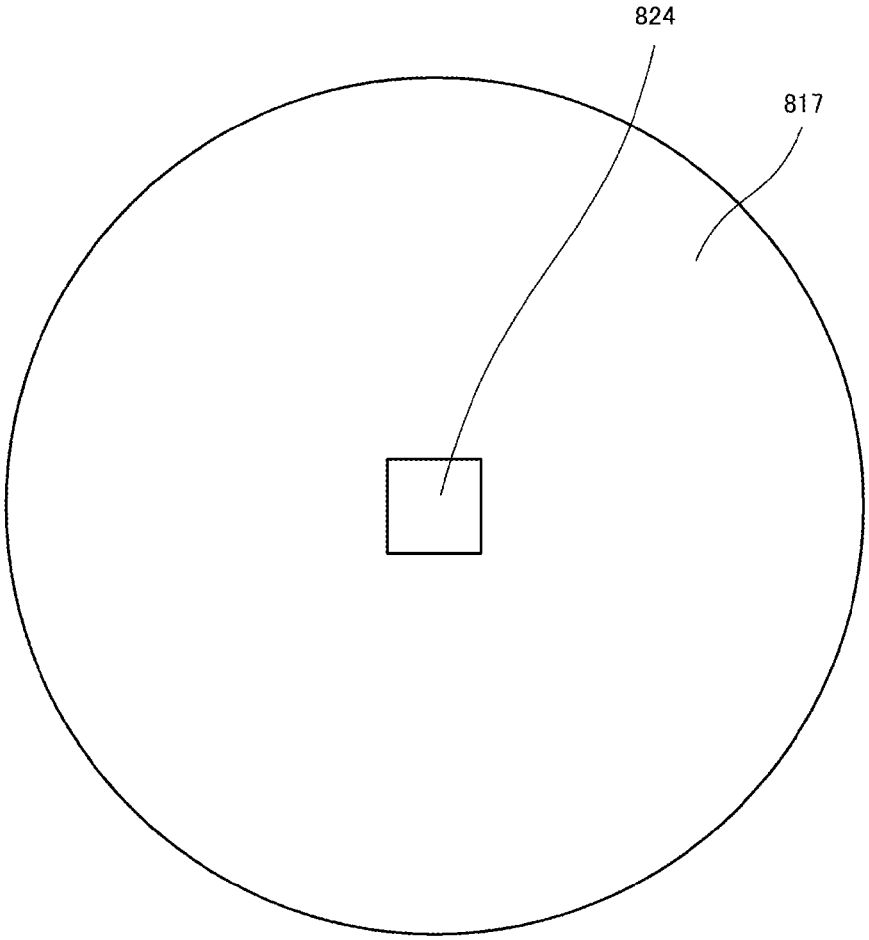

FIG. 24 is a plan view of a housing 817 according to a fourth modified example, obtained by modifying the housing 17 illustrated in FIG. 1.

Figure 3:
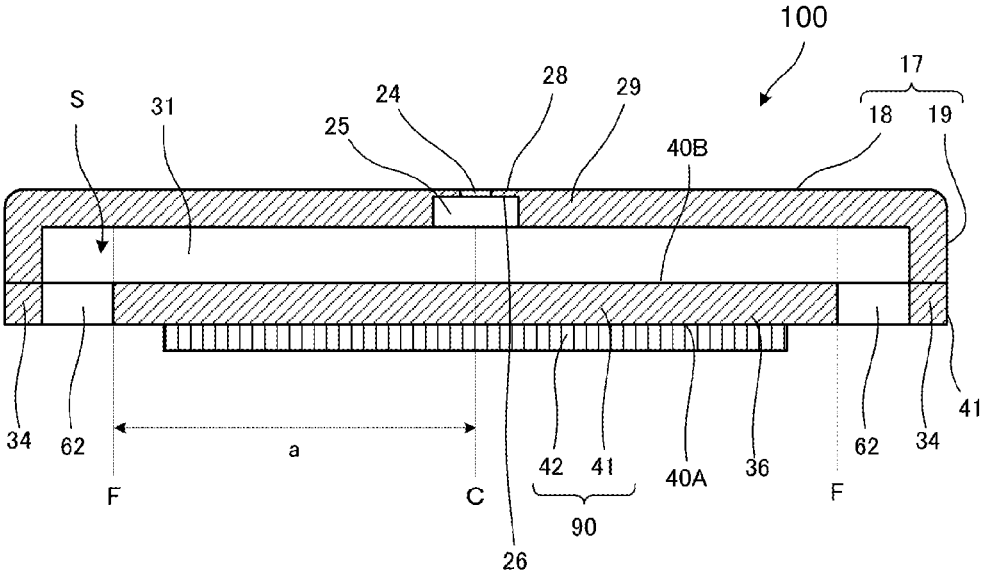
FIG. 3 is a cross-sectional view of the piezoelectric blower 100 illustrated in FIG. 1 taken along line S-S.
Figure 25:
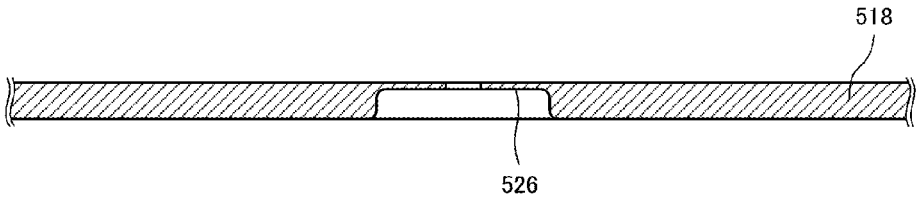

FIG. 25 is a cross-sectional view of a top plate portion 518 according to a first modified example, obtained by modifying a top plate portion 18 illustrated in FIG. 3.

Figure 26:
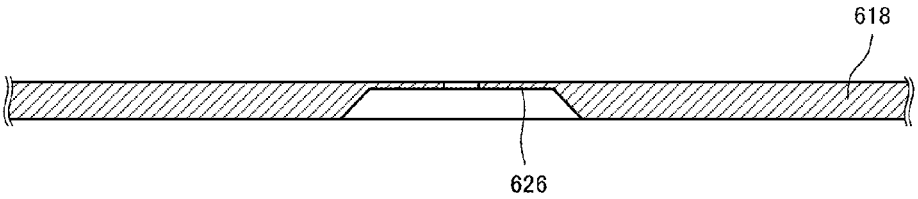

FIG. 26 is a cross-sectional view of a top plate portion 618 according to a second modified example, obtained by modifying the top plate portion 18 illustrated in FIG. 3.

Figure 27:
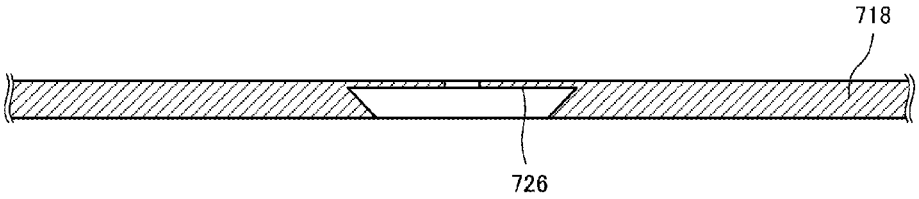

FIG. 27 is a cross-sectional view of a top plate portion 718 according to a third modified example, obtained by modifying the top plate portion 18 illustrated in FIG. 3.

Figure 28:
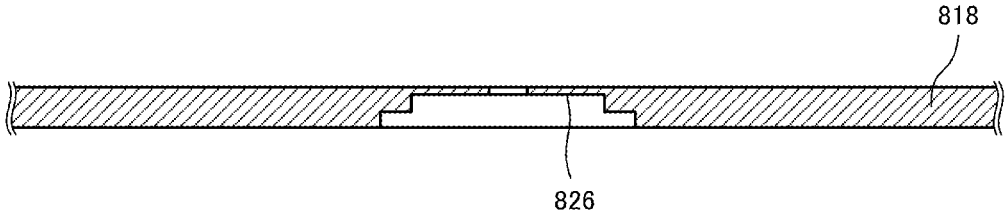

FIG. 28 is a cross-sectional view of a top plate portion 818 according to a fourth modified example, obtained by modifying the top plate portion 18 illustrated in FIG. 3.

Figure 29:
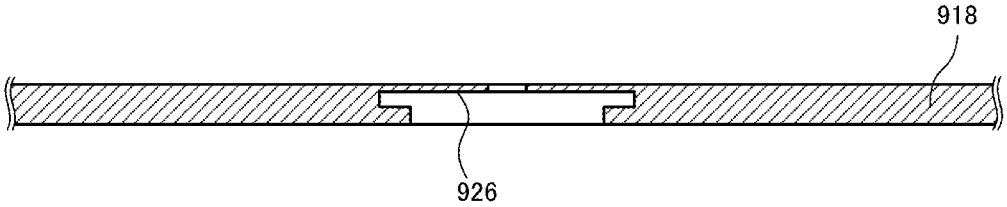

FIG. 29 is a cross-sectional view of a top plate portion 918 according to a fifth modified example, obtained by modifying the top plate portion 18 illustrated in FIG. 3.

DETAILED DESCRIPTION OF THE DISCLOSURE

First Embodiment of the Present Disclosure

Hereinbelow, a piezoelectric blower 100 according to a first embodiment of the present disclosure is described.

Figure 2:
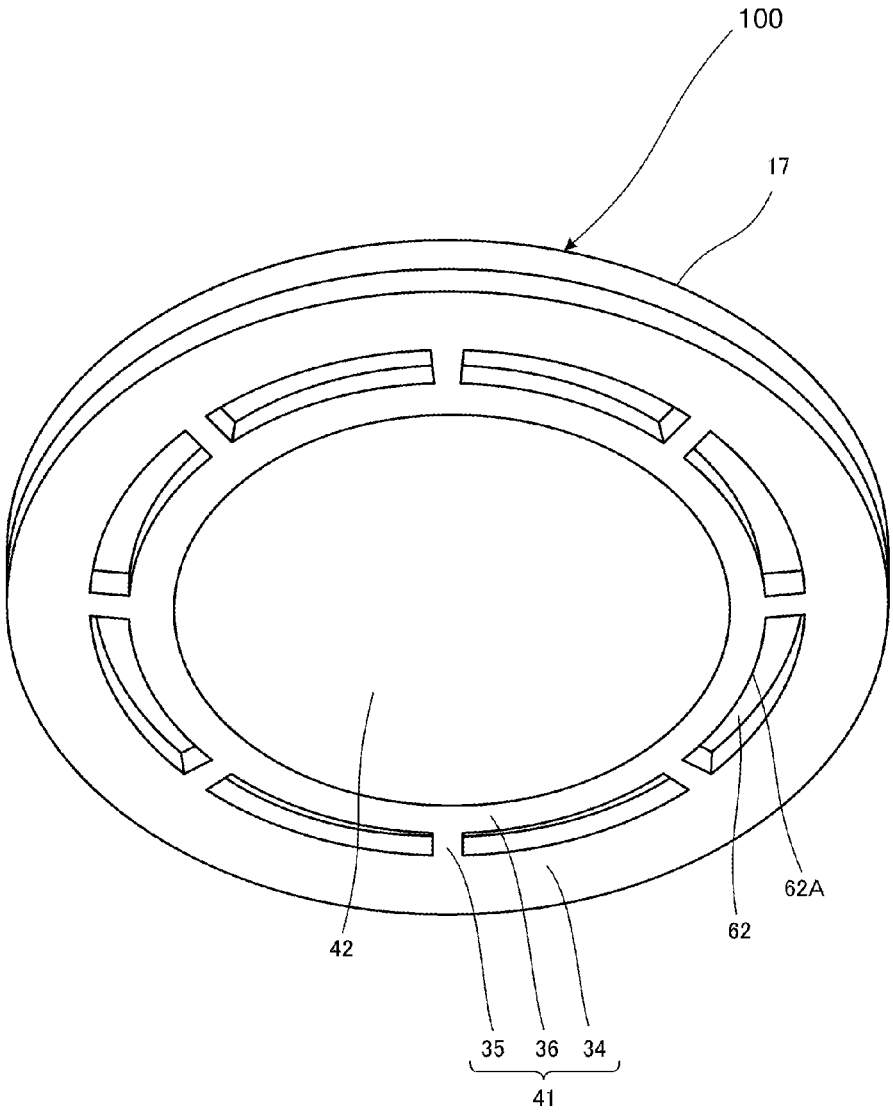
FIG. 2 is an external perspective view of the piezoelectric blower 100 illustrated in FIG. 1.

FIG. 1 is an external perspective view of the piezoelectric blower 100 according to the first embodiment of the present disclosure. FIG. 2 is another external perspective view of the piezoelectric blower 100 illustrated in FIG. 1. FIG. 3 is a cross-sectional view of the piezoelectric blower 100 illustrated in FIG. 1 taken along line S-S.

The piezoelectric blower 100 includes a housing 17, a vibrating plate 41, and a piezoelectric element 42 in that order from the top, and has a structure in which these components are successively stacked one on top of another.

Here, the piezoelectric element 42 corresponds to a "driving member" according to the present disclosure.

The vibrating plate 41 is disc-shaped, and is made of a material such as stainless steel (SUS). In this embodiment, the thickness of the vibrating plate 41 is, for example, 0.6 mm. The diameter of a vent hole 24 is, for example, 0.6 mm. The vibrating plate 41 has a first principal surface 40A and a second principal surface 40B.

The second principal surface 40B of the vibrating plate 41 is joined to the end of the housing 17. The vibrating plate 41 thus defines a column-shaped blower chamber 31 together with the housing 17 such that the blower chamber 31 is interposed between the vibrating plate 41 and the housing 17 in a thickness direction of the vibrating plate 41. The vibrating plate 41 and the housing 17 are formed so that the blower chamber 31 has a radius a. For example, in the embodiment, the radius a of the blower chamber 31 is 6.1 mm.

The vibrating plate 41 also has openings 62 that connect an outer periphery of the blower chamber 31 to the outside of the blower chamber 31. As illustrated in FIG. 2, each opening has a shape of a fan having an arc 62A. The openings 62 are formed along substantially the entire circumference of the vibrating plate 41 so as to surround the blower chamber 31. The opening ratio of the openings 62 is thus approximately 90% in this embodiment. The vibrating plate 41 thus includes an outer peripheral portion 34, multiple beam portions 35, and a vibrating portion 36. The outer peripheral portion 34 is ring-shaped. The vibrating portion 36 is disc-shaped. The vibrating portion 36 is located further inward from the openings of the outer peripheral portion 34 while being spaced apart from the outer peripheral portion 34. The multiple beams portions 35 are disposed in a gap between the outer peripheral portion 34 and the vibrating portion 36, and connect the vibrating portion 36 and the outer peripheral portion 34 to each other.

The vibrating portion 36 is thus supported in midair using the beam portions 35, and is vertically movable in the thickness direction.

Here, the opening ratio is defined as the ratio of how much the space interposed between the vibrating plate and the housing communicates with the outside of a joined body, in which the vibrating plate and the housing are joined. In this embodiment, the opening ratio is a proportion of the total sum of the lengths of the arcs of all the openings 62 on the side of the vibrating plate 41 to the length of the entire outer circumference of an area of the vibrating plate 41 located further inward from the circle obtained by connecting all the openings 62 together when the second principal surface 40B of the vibrating plate 41 is viewed from the front.

Thus, the space S interposed between the vibrating plate 41 and the housing 17 is in contact with the openings 62 having an opening ratio of 50% or higher. The blower chamber 31 refers to a space located further inward from the openings 62 when the first principal surface 40A of the vibrating plate 41 is viewed from the front (more precisely, the space located further inward from the circle obtained by connecting all the openings 62 together).

A portion of the principal surface of the vibrating portion 36 in which the vent hole 24 is formed, the portion being located further inward from the circle obtained by connecting all the openings 62 together, forms a bottom surface of the blower chamber 31. The vibrating plate 41 is formed by, for example, blanking out a metal plate.

The piezoelectric element 42 is disc-shaped, and is made of a material such as a lead zirconate titanate ceramic. Electrodes are formed on both principal surfaces of the piezoelectric element 42. The piezoelectric element 42 is joined to the first principal surface 40A of the vibrating plate 41 that is opposite to the surface facing the blower chamber 31, and expands and contracts in accordance with an application of an alternating voltage. A joined body obtained by joining the piezoelectric element 42 and the vibrating plate 41 to each other serves as a piezoelectric actuator 90.

The housing 17 has a C-shaped cross section having an open bottom. The end of the housing 17 is joined to the vibrating plate 41. The housing 17 is made of a material such as a metal.

The housing 17 includes a disc-shaped top plate portion 18 opposing to the second principal surface 40B of the vibrating plate 41 and a ring-shaped side wall portion 19 that is continuous with the top plate portion 18. A portion of the top plate portion 18 serves as a top surface of the blower chamber 31.

The top plate portion 18 includes the column-shaped vent hole 24 that connects a central portion of the blower chamber 31 to the outside of the blower chamber 31. The central portion of the blower chamber 31 is a portion that overlaps the piezoelectric element 42 when the first principal surface 40A of the vibrating plate 41 is viewed from the front.

The top plate portion 18 includes a thick top portion 29 and a thin top portion 28 located on the inner circumferential side of the thick top portion 29. The vent hole 24, which connects the central portion of the blower chamber 31 to the outside of the blower chamber 31, is formed in the thin top portion 28 of the top plate portion 18. The thickness of the thick top portion 29 is, for example, 0.55 mm and the thickness of the thin top portion 28 is, for example, 0.05 mm. The diameter of the vent hole 24 is, for example, 0.6 mm.

The central portion of the blower chamber 31 is a portion that overlaps the piezoelectric element 42 when the first principal surface 40A of the vibrating plate 41 is viewed from the front.

At a portion of the top plate portion 18 facing the vibrating plate 41, a recessed portion 26 is formed. The recessed portion 26 constitutes the blower chamber 31 and defines a cavity 25 that communicates with the vent hole 24. The cavity 25 is a column-shaped communication space. The diameter of the cavity 25 is, for example, 3.0 mm. The thickness of the cavity 25 is, for example, 0.5 mm.

The flow of air when the piezoelectric blower 100 is in operation is described below.

FIGS. 4A and 4B are cross-sectional views of the piezoelectric blower 100 illustrated in FIG. 1 taken along line S-S, when the piezoelectric blower 100 is operated at a first-order mode resonance frequency (fundamental). FIG. 4A illustrates the case where the blower chamber 31 has a maximum volume, and FIG. 4B illustrates the case where the blower chamber 31 has a minimum volume. Here, the illustrated arrows denote the flow of air.

FIG. 5 shows the relationship between pressure change at each point in the blower chamber 31 from a central axis C of the vibrating plate 41 to the outer periphery of the blower chamber 31 and displacement at each point on the vibrating plate 41 from the central axis C of the vibrating plate 41 to the outer periphery of the blower chamber 31, at a moment when the piezoelectric blower 100 illustrated in FIG. 1 is in the state illustrated in FIG. 4B. FIG. 5 is a graph obtained by simulation.

Here, in FIG. 5, the pressure change at each point in the blower chamber 31 and the displacement at each point on the vibrating plate 41 are indicated by values standardized on the basis of the displacement of the center of the vibrating plate 41 located on the central axis C of the blower chamber 31. A pressure change distribution u(r) of the points in the blower chamber 31 shown in FIG. 5 is described later.

FIG. 6 shows the relationship between a radius a multiplied by a resonance frequency f and pressure amplitude in the piezoelectric blower 100 illustrated in FIG. 1. FIG. 6 is a graph in which the pressure amplitude is obtained by varying a radius a multiplied by a resonance frequency f by simulation. The dotted lines in FIG. 6 indicate a maximum value, and a lower limit and an upper limit of a range satisfying the relationship of $0.8\times(k_0c)/(2\pi)\leq af\leq 1.2\times(k_0c)/(2\pi)$. The lower limit value is 104 m/s, the upper limit value is 156 m/s, and the maximum value is 130 m/s.

Similarly, the alternate long and short dashed lines in FIG. 6 indicate a lower limit and an upper limit of a range satisfying the relationship of $0.9\times(k_0c)/(2\pi)\leq af\leq 1.1\times(k_0c)/(2\pi)$. The lower limit value is 117 m/s, and the upper limit value is 143 m/s.

The pressure amplitude illustrated in FIG. 6 is standardized on the basis of the vibration speed at a central portion of the piezoelectric element 42. Since the fracture limitation of the piezoelectric element 42 serves as the upper limit, the pressure amplitude at the time when the vibration speed=1 m/s is graphed in the measurement illustrated in FIG. 6.

When, in the state illustrated in FIG. 3, an alternating drive voltage with the first-order mode resonance frequency (fundamental) is applied to the electrodes on the two principal surfaces of the piezoelectric element 42, the piezoelectric element 42 expands and contracts and causes the vibrating plate 41 to concentrically bend and vibrate at the first-order mode resonance frequency f.

Thus, the vibrating plate 41 is bent and deformed as illustrated in FIGS. 4A and 4B, and the volume of the blower chamber 31 changes periodically.

The radius a of the blower chamber 31 and the resonance frequency f of the vibrating plate 41 satisfy the relationship of $0.8\times(k_0c)/(2\pi)\leq af\leq 1.2\times(k_0c)/(2\pi)$, where the acoustic velocity of air that passes through the blower chamber 31 is denoted by c and a value that satisfies the relationship of the Bessel function of the first kind of $J_0(k_0)=0$ is denoted by $k_0$.

In this embodiment, the radius a of the blower chamber 31 is the shortest distance from the central axis C of the vibrating plate 41 to an end F of an area of the vibrating plate 41, the area being located further inward from the openings 62 when the first principal surface 40A is viewed from the front (more precisely, the area of the vibrating plate 41 located further inward from the circle obtained by connecting all the openings 62 together), since the space S interposed between the vibrating plate 41 and the housing 17 is in contact with the openings 62 having an opening ratio of 50% or higher. The resonance frequency f of the vibrating plate 41 is 21.7 kHz. The resonance frequency f of the vibrating plate 41 is determined by parameters such as the thickness of the vibrating plate 41 and the material of the vibrating plate 41. The acoustic velocity c of air is 340 m/s. $k_0$ is 2.40. The Bessel function of the first kind $J_0(x)$ is expressed by the following numerical formula.

[Formula 1]

$$J_0(x) = \sum_{m=0}^{\infty} \frac{(-1)^m}{m!\Gamma(m+1)}\left(\frac{x}{2}\right)^{2m} \qquad \text{Formula 1}$$

The pressure change distribution u(r) of the points in the blower chamber 31 is expressed by the formula $u(r)=J_0(k_0r/a)$, where the distance from the central axis C of the vibrating plate 41 is denoted by r.

As illustrated in FIG. 4A, when the vibrating plate 41 bends toward the piezoelectric element 42, the volume of the blower chamber 31 increases. This increase of the volume causes air outside the piezoelectric blower 100 to be sucked into the blower chamber 31 through the vent hole 24 and the openings 62.

As illustrated in FIG. 4B, when the vibrating plate 41 bends toward the blower chamber 31, the volume of the blower chamber 31 decreases. This decrease of the volume causes air inside the blower chamber 31 to be ejected through the vent hole 24 and the openings 62.

As shown in FIGS. 4A and 4B and the dotted line in FIG. 5, each point on the vibrating plate 41 from the central axis C of the vibrating plate 41 to the outer periphery of the blower chamber 31 is displaced by vibration. As shown by the solid line in FIG. 5, from the central axis C of the vibrating plate 41 to the outer periphery of the blower chamber 31, the pressure at each point in the blower chamber 31 changes due to the vibrating plate 41 being vibrated.

As shown by the dotted line and the solid line in FIG. 5, in the range from the central axis C of the vibrating plate 41 to the outer periphery of the blower chamber 31, the number of zero crossover points of the vibration displacement of the vibrating plate 41 is zero, and the number of zero crossover points of the pressure change in the blower chamber 31 is also zero. Therefore, the number of zero crossover points of the vibration displacement of the vibrating plate 41 is equal to the number of zero crossover points of the pressure change in the blower chamber 31.

Therefore, in the piezoelectric blower 100, when the vibrating plate 41 vibrates, a distribution of the displacements of the respective points on the vibrating plate 41 approximates to the distribution of the pressure changes at the respective points in the blower chamber 31.

Here, when $af=(k_0c)/(2\pi)$, a node F of vibration of the vibrating plate 41 coincides with a node of pressure vibration of the blower chamber 31, and pressure resonance occurs. Even when the relationship of $0.8\times(k_0c)/(2\pi)\leq af\leq 1.2\times(k_0c)/(2\pi)$ is satisfied, the node F of vibration of the vibrating plate 41 substantially coincides with the node of pressure vibration of the blower chamber 31.

The piezoelectric blower 100 is used for sucking a viscous liquid, such as nasal mucus or phlegm. In order to prevent the piezoelectric element from being broken as a result of long-time driving, the vibration speed of the piezoelectric element needs to be lower than or equal to 2 m/s. Sucking of nasal mucus or phlegm requires a pressure of 20 kPa or greater. The piezoelectric blower 100 thus requires a pressure amplitude of 10 kPa/(m/s) or greater. As illustrated in FIG. 6, the pressure amplitude reaches a maximum when af is 130 m/s. When af is 117 m/s and 143 m/s that deviate by ±10% from 130 m/s, a pressure amplitude of 20 kPa/(m/s) or greater can be obtained. Even when af is 104 m/s and 156 m/s that deviate by ±20% from 130 m/s, a pressure amplitude of 10 kPa/(m/s) or greater can be obtained.

Thus, when the relationship of $0.8\times(k_0c)/(2\pi)\leq af\leq 1.2\times(k_0c)/(2\pi)$ is satisfied, the piezoelectric blower 100 can produce high discharge pressure and high discharge flow rate usable to suck a viscous liquid, such as nasal mucus or phlegm.

Further, when the relationship of $0.9\times(k_0c)/(2\pi)\leq af\leq 1.1\times(k_0c)/(2\pi)$ is satisfied, the piezoelectric blower 100 can produce very high discharge pressure and very high discharge flow rate.

The piezoelectric blower 100 has a cavity 25 near the vent hole 24 of the blower chamber 31. Thus, in the piezoelectric blower 100, a swirl that occurs near the vent hole 24 of the blower chamber 31 is weakened in the cavity 25. This configuration is thus capable of preventing pressure vibration in the blower chamber 31 from being disturbed by the swirl.

The piezoelectric blower 100 is thus capable of weakening a swirl occurring near the vent hole 24 of the blower chamber 31 and minimizing reduction of discharge pressure.

In the piezoelectric blower 100, when the vibrating plate 41 vibrates, a distribution of the displacements of the respective points on the vibrating plate 41 approximates to the distribution of the pressure changes at the respective points in the blower chamber 31. In other words, when the vibrating plate 41 vibrates, each point on the vibrating plate 41 is displaced in accordance with the pressure change of the corresponding point in the blower chamber 31.

Thus, the piezoelectric blower 100 is capable of transmitting vibration energy of the vibrating plate 41 to the air in the blower chamber 31 without losing most of the vibration energy. Thus, the piezoelectric blower 100 is capable of producing high discharge pressure and high discharge flow rate.

In the piezoelectric blower 100, since the outer periphery of the blower chamber 31 serves as the node of pressure vibration in the blower chamber 31, the pressure at the outer periphery of the blower chamber 31 is atmospheric pressure at all times. The piezoelectric blower 100 can thus prevent a reduction in discharge pressure and discharge flow rate even though the outer periphery of the blower chamber 31 communicates with the outside of the blower chamber 31 through the large openings 62.

Thus, the piezoelectric blower 100 can prevent the openings 62 from becoming clogged with, for example, dust since the openings 62 are large. In other words, the piezoelectric blower 100 can prevent a reduction in discharge pressure and discharge flow rate caused by dust or the like.

Hereinbelow, the piezoelectric blower 100 according to the first embodiment of the present disclosure is compared to a piezoelectric blower 150 according to a comparative example provided for comparison with the first embodiment of the present disclosure.

FIG. 7 is a cross-sectional view of the piezoelectric blower 150 according to the comparative example provided for comparison with the first embodiment of the present disclosure. The piezoelectric blower 150 differs from the piezoelectric blower 100 in that the piezoelectric blower 150 has a cavity 25, communicating with the vent hole 24, on the side of a top plate portion 168 of a housing 167 opposite to the side on which the vibrating plate 41 is disposed. This cavity 25 does not constitute a blower chamber 181. Other points are the same as those in the piezoelectric blower 100 and thus are not described.

Now, measurement results of wind power (mN) of air flowing out from the vent hole 24 of the piezoelectric blower 150 and wind power (mN) of air flowing out from the vent hole 24 of the piezoelectric blower 100 are described below, the results being obtained under the conditions that a sinusoidal alternating-current voltage of 50 Vpp with a resonance frequency f (21.7 kHz) was applied to the piezoelectric blower 150 and the piezoelectric blower 100.

The experiments revealed that the piezoelectric blower 150 produces wind power of air of 744.8 (mN) whereas the piezoelectric blower 100 produces wind power of air of 1244.6 (mN).

The reason why the above results are obtained is probably because, in the piezoelectric blower 100, a swirl occurring near the vent hole 24 of the blower chamber 31 is weakened in the cavity 25, so that the pressure vibration in the blower chamber 31 is successfully prevented from being disturbed by the swirl.

Thus, the piezoelectric blower 100 according to this embodiment is capable of weakening a swirl occurring near the vent hole 24 of the blower chamber 31 and minimizing reduction of discharge pressure.

In the first embodiment, a valve 80, which prevents gas from flowing into the blower chamber 31 from the outside through the vent hole 24, may be provided to the top plate portion 18 (see FIG. 8).

In the case, as illustrated in FIG. 8, where the valve 80 is disposed at the vent hole 24 of the housing 17, nonlinear pressure change occurs in the blower chamber 31 as a result of opening or closing of the valve 80. Thus, a swirl is more likely to occur near the vent hole 24 of the blower chamber 31. Thus, the cavity 25 is particularly effective in a piezoelectric blower 160 including the valve 80.

Second Embodiment of the Present Disclosure

A piezoelectric blower 200 according to a second embodiment of the present disclosure is described below.

FIG. 9 is a cross-sectional view of a piezoelectric blower 200 according to a second embodiment of the present disclosure. The piezoelectric blower 200 differs from the piezoelectric blower 100 in terms of the dimensions of the vibrating plate 241 and a housing 217 and in that the piezoelectric blower 200 includes a reinforcing plate 70.

The piezoelectric blower 200 includes a housing 217, a vibrating plate 241, a reinforcing plate 70, and a piezoelectric element 42 in that order from the top, and has a structure in which these components are successively stacked one on top of another.

The vibrating plate 241 is disc-shaped and is made of a material such as stainless steel (SUS). In this embodiment, the thickness of the vibrating plate 241 is, for example, 0.1 mm. The vibrating plate 241 has a first principal surface 240A and a second principal surface 240B.

The second principal surface 240B of the vibrating plate 241 is joined to the end of the housing 217. Thus, the vibrating plate 241 defines a column-shaped blower chamber 231 together with the housing 217 such that the blower chamber 231 is interposed between the vibrating plate 241 and the housing 217 in a thickness direction of the vibrating plate 241. The vibrating plate 241 and the housing 217 are formed so that the blower chamber 231 has a radius a. For example, in the embodiment, the radius a of the blower chamber 231 is 6.1 mm.

The vibrating plate 241 has openings 262 that connect the outer periphery of the blower chamber 231 to the outside of the blower chamber 231. The openings 262 are formed substantially throughout the periphery of the vibrating plate 241 so as to surround the blower chamber 231. Thus, an area of the second principal surface 240B of the vibrating plate 241 located further inward from the openings 262 serves as a bottom surface of the blower chamber 231. The vibrating plate 241 is formed by, for example, blanking out a metal plate.

The reinforcing plate 70 is disc-shaped and is made of a material such as stainless steel. The reinforcing plate 70 is joined to the first principal surface 240A of the vibrating plate 241. The diameter of the reinforcing plate 70 is, for example, 11 mm and the thickness of the reinforcing plate 70 is, for example, 0.5 mm.

The piezoelectric element 42 is joined to a principal surface 240C of the reinforcing plate 70, opposite to the surface to which the blower chamber 231 is disposed. A joined body obtained by joining the piezoelectric element 42, the reinforcing plate 70, and the vibrating plate 241 together serves as a piezoelectric actuator 290.

In this embodiment, the vibrating plate 241 and the reinforcing plate 70 serve as a "vibrating plate" of the present disclosure. The first principal surface 240A corresponds to a "first principal surface" of the present disclosure and the principal surface 240C corresponds to a "second principal surface" of the present disclosure.

The housing 217 has a C-shaped cross section having an open bottom. The end of the housing 217 is joined to the vibrating plate 241. The housing 217 is made of a material such as a metal.

The housing 217 includes a disc-shaped top plate portion 218 opposing to the second principal surface 240B of the vibrating plate 241 and a ring-shaped side wall portion 19 that is continuous with the top plate portion 218. Part of the top plate portion 218 serves as a top surface of the blower chamber 231.

The top plate portion 218 has a column-shaped vent hole 24 that connects a central portion of the blower chamber 231 to the outside of the blower chamber 231. The central portion of the blower chamber 231 is a portion that overlaps the piezoelectric element 42 when the first principal surface 240A of the vibrating plate 241 is viewed from the front.

The top plate portion 218 includes a thick top portion 229 and a thin top portion 28 that is positioned on an inner-peripheral side of the thick top portion 229. The thin top portion 28 of the top plate portion 218 has a vent hole 24 that connects the central portion of the blower chamber 231 to the outside of the blower chamber 231. The thickness of the thick top portion 229 is, for example, 0.2 mm. The thickness of the thin top portion 28 is, for example, 0.05 mm.

The central portion of the blower chamber 231 is a portion that overlaps the piezoelectric element 42 when the first principal surface 240A of the vibrating plate 241 is viewed from the front.

A recessed portion 226 is formed in the top plate portion 218 on the side facing the vibrating plate 241. The recessed portion 226 defines a cavity 225, which constitutes the blower chamber 231 and communicates with a vent hole 24. The cavity 225 is column-shaped. The diameter of the cavity 225 is, for example, 2.0 mm, and the thickness of the cavity 225 is, for example, 0.15 mm.

Hereinbelow, the flow of air while the piezoelectric blower 200 is in operation is described.

FIG. 10 shows the relationship between pressure change at each point in the blower chamber 231 from a central axis C of the vibrating plate 241 to the outer periphery of the blower chamber 231 and displacement at each point on the vibrating plate 241 from the central axis C of the vibrating plate 241 to the outer periphery of the blower chamber 231, at a predetermined moment while the piezoelectric blower 200 illustrated in FIG. 9 is being driven. FIG. 10 is a graph obtained by simulation.

Here, in FIG. 10, the pressure change at each point in the blower chamber 231 and the displacement at each point on the vibrating plate 241 are indicated by values standardized on the basis of the displacement of the center of the vibrating plate 241 located on the central axis C of the vibrating plate 241. A pressure change distribution u(r) of the points in the blower chamber 231 shown in FIG. 10 is expressed by the formula $u(r)=J_0(k_0r/a)$, where the distance from the central axis C of the vibrating plate 241 is denoted by r.

When, in the state illustrated in FIG. 9, an alternating drive voltage with the third-order mode resonance frequency is applied to the electrodes on the two principal surfaces of the piezoelectric element 42, the piezoelectric element 42 expands and contracts and causes the vibrating plate 241 and the reinforcing plate 70 to concentrically bend and vibrate at the third-order mode resonance frequency f.

As in the case of the piezoelectric blower 100 illustrated in FIGS. 4A and 4B, the vibrating plate 241 is thus bent and deformed, so that the volume of the blower chamber 231 changes periodically.

The radius a of the blower chamber 231 and the resonance frequency f of the vibrating plate 241 satisfy the relationship of $0.8\times(k_0c)/(2\pi)\leq af\leq 1.2\times(k_0c)/(2\pi)$, where the acoustic velocity of air that passes through the blower chamber 231 is denoted by c and a value that satisfies the relationship of the Bessel function of the first kind of $J_0(k_0)=0$ is denoted by $k_0$.

In this embodiment, the radius a of the blower chamber 231 is the shortest distance from the central axis C of the vibrating plate 241 to an end F of an area of the vibrating plate 241, the area being located further inward from the openings 262 when the first principal surface 240A is viewed from the front (more precisely, the area of the vibrating plate 241 located further inward from the circle obtained by connecting all the openings 262 together), since the space S interposed between the vibrating plate 241 and the housing 217 is in contact with the openings 262 having an opening ratio of 50% or higher. The resonance frequency f is 47.0 kHz. The acoustic velocity c of air is 340 m/s. $k_0$ is 5.52.

Here, as shown by the dotted line in FIG. 10, each point on the vibrating plate 241 from the central axis C of the vibrating plate 241 to the outer periphery of the blower chamber 231 is displaced by vibration. As shown by the solid line in FIG. 10, from the central axis C of the vibrating plate 241 to the outer periphery of the blower chamber 231, the pressure at each point in the blower chamber 231 changes due to the vibrating plate 241 being vibrated.

As shown by the dotted line and the solid line in FIG. 10, in the range from the central axis C of the vibrating plate 241 to the outer periphery of the blower chamber 231, the number of zero crossover points of the vibration displacement of the vibrating plate 241 is one, and the number of zero crossover points of the pressure change in the blower chamber 231 is also one. Therefore, the number of zero crossover points of the vibration displacement of the vibrating plate 241 is equal to the number of zero crossover points of the pressure change in the blower chamber 231.

Therefore, in the piezoelectric blower 200, when the vibrating plate 241 vibrates, a distribution of the displacements of the respective points on the vibrating plate 241 approximates to the distribution of the pressure changes at the respective points in the blower chamber 231.

Here, when $af=(k_0c)/(2\pi)$, a node F of vibration of the vibrating plate 241 coincides with a node of pressure vibration of the blower chamber 231, and pressure resonance occurs. Further, even when the relationship of $0.8\times(k_0c)/(2\pi)\leq af\leq 1.2\times(k_0c)/(2\pi)$ is satisfied, the node F of vibration of the vibrating plate 241 substantially coincides with the node of pressure vibration of the blower chamber 231.

The piezoelectric blower 200 is used for sucking a viscous liquid, such as nasal mucus or phlegm. In order to prevent the piezoelectric element from being broken as a result of long-time driving, the vibration speed of the piezoelectric element needs to be lower than or equal to 2 m/s. Since sucking nasal mucus or phlegm requires a pressure of 20 kPa or greater, the piezoelectric blower 200 requires a pressure amplitude of 10 kPa/(m/s) or greater.

When the relationship of $0.8\times(k_0c)/(2\pi)\leq af\leq 1.2\times(k_0c)/(2\pi)$ is satisfied, the piezoelectric blower 200 can obtain a pressure amplitude of 10 kPa/(m/s) or greater.

Thus, when the relationship of $0.8\times(k_0c)/(2\pi)\leq af\leq 1.2\times(k_0c)/(2\pi)$ is satisfied, the piezoelectric blower 200 can produce high discharge pressure and high discharge flow rate usable to suck a viscous liquid, such as nasal mucus or phlegm.

Further, when the relationship of $0.9\times(k_0c)/(2\pi)\leq af\leq 1.1\times(k_0c)/(2\pi)$ is satisfied, the piezoelectric blower 200 can produce very high discharge pressure and very high discharge flow rate.

The piezoelectric blower 200 has a cavity 225 near the vent hole 24 of the blower chamber 231. Thus, in the piezoelectric blower 200, a swirl that occurs near the vent hole 24 of the blower chamber 231 is weakened in the cavity 225. This configuration is thus capable of preventing pressure vibration in the blower chamber 231 from being disturbed by the swirl.

The piezoelectric blower 200 is thus capable of weakening a swirl occurring near the vent hole 24 of the blower chamber 231 and minimizing reduction of discharge pressure.

In the piezoelectric blower 200, when the vibrating plate 241 vibrates, a distribution of the displacements of the respective points on the vibrating plate 241 approximates to the distribution of the pressure changes at the respective points in the blower chamber 231. In other words, when the vibrating plate 241 vibrates, each point on the vibrating plate 241 is displaced in accordance with the pressure change of the corresponding point in the blower chamber 231.

Thus, the piezoelectric blower 200 is capable of transmitting vibration energy of the vibrating plate 241 to the air in the blower chamber 231 without losing most of the vibration energy. Thus, the piezoelectric blower 200 is capable of producing high discharge pressure and high discharge flow rate.

In the piezoelectric blower 200, the outer periphery of the blower chamber 231 serves as the node of pressure vibration of the blower chamber 231. Thus, the pressure at the outer periphery of the blower chamber 231 is atmospheric pressure at all times. The piezoelectric blower 200 can thus prevent a reduction in discharge pressure and discharge flow rate even though the outer periphery of the blower chamber 231 communicates with the outside of the blower chamber 231 through the large openings 262.

The piezoelectric blower 200 can prevent the openings 262 from becoming clogged with, for example, dust since the openings 262 are large. In other words, the piezoelectric blower 200 can prevent a reduction in discharge pressure and discharge flow rate caused by, for example, dust.

Thus, the piezoelectric blower 200 according to the second embodiment has the same advantages as the piezoelectric blower 100 according to the first embodiment.

Hereinbelow, the piezoelectric blower 200 according to the second embodiment of the present disclosure is compared to a piezoelectric blower 250 according to a comparative example provided for comparison with the second embodiment of the present disclosure.

FIG. 11 is a cross-sectional view of the piezoelectric blower 250 according to a comparative example provided for comparison with the second embodiment of the present disclosure. The piezoelectric blower 250 differs from the piezoelectric blower 200 in that the piezoelectric blower 250 has a cavity 225, communicating with a vent hole 24, on the side of a top plate portion 268 of a housing 267 opposite to the side on which the vibrating plate 241 is disposed. This cavity 225 does not constitute a blower chamber 281. Other points are the same as those in the piezoelectric blower 200 and thus are not described.

Now, measurement results of wind power (mN) of air flowing out from the vent hole 24 of the piezoelectric blower 250 and wind power (mN) of air flowing out from the vent hole 24 of the piezoelectric blower 200 are described below, the results being obtained under the conditions that a sinusoidal alternating-current voltage of 30 Vpp with a resonance frequency f (47.0 kHz) was applied to the piezoelectric blower 250 and the piezoelectric blower 200.

The experiments revealed that the piezoelectric blower 250 produces wind power of air of 1136.8 (mN) whereas the piezoelectric blower 200 produces wind power of air of 1960 (mN).

The reason why the above results are obtained is probably because, in the piezoelectric blower 200, a swirl occurring near the vent hole 24 of the blower chamber 231 is weakened in the cavity 225, so that the pressure vibration in the blower chamber 231 is successfully prevented from being disturbed by the swirl.

Thus, the piezoelectric blower 200 according to this embodiment is capable of weakening a swirl occurring near the vent hole 24 of the blower chamber 231 and minimizing reduction of discharge pressure.

In the second embodiment, a valve 80, which prevents gas from flowing into the blower chamber 231 from the outside through the vent hole 24, may be provided to the top plate portion 218 (see FIG. 12).

In the case, as illustrated in FIG. 12, where the valve 80 is disposed at the vent hole 24 of the housing 217, nonlinear pressure change occurs in the blower chamber 231 as a result of opening or closing of the valve 80. Thus, a swirl is more likely to occur near the vent hole 24 of the blower chamber 231. Thus, the cavity 225 is particularly effective in a piezoelectric blower 260 including the valve 80.

Third Embodiment of the Present Disclosure

A piezoelectric blower 300 according to a third embodiment of the present disclosure is described below.

FIG. 13 is a cross-sectional view of the piezoelectric blower 300 according to the third embodiment of the present disclosure. The piezoelectric blower 300 differs from the piezoelectric blower 200 in terms of the dimensions of a vibrating plate 341 and a housing 317 and in that the piezoelectric blower 300 does not have openings in a vibrating plate 341.

In the piezoelectric blower 300, since the outer periphery of a blower chamber 331 does not communicate with the outside of the blower chamber 331, the opening ratio of the outer periphery of the blower chamber 331 is 0%. A space S interposed between the vibrating plate 341 and the housing 317 is not in contact with the openings having an opening ratio of 50% or higher (in other words, every portion of the circle has a shield proportion exceeding 50%). Thus, the blower chamber 331 refers to the space S interposed between the vibrating plate 341 and the housing 317.

The piezoelectric blower 300 includes a housing 317, a vibrating plate 341, a reinforcing plate 70, and a piezoelectric element 42 in that order from the top, and has a structure in which these components are successively stacked one on top of another.

The vibrating plate 341 is disc-shaped and is made of a material such as stainless steel (SUS). In this embodiment, the thickness of the vibrating plate 341 is, for example, 0.1 mm. The vibrating plate 341 has a first principal surface 340A and a second principal surface 340B.

The second principal surface 340B of the vibrating plate 341 is joined to the end of the housing 317. Thus, the vibrating plate 341 defines a column-shaped blower chamber 331 together with the housing 317 such that the blower chamber 331 is interposed between the vibrating plate 341 and the housing 317 in a thickness direction of the vibrating plate 341. The vibrating plate 341 and the housing 317 are formed so that the blower chamber 331 has a radius a. For example, in the embodiment, the radius a of the blower chamber 331 is 9.4 mm.

An area of the second principal surface 340B of the vibrating plate 341 located further inward from a joint portion at which the vibrating plate 341 is joined to a housing 317 thus serves as a bottom surface of the blower chamber 331.

The reinforcing plate 70 is joined to the first principal surface 340A of the vibrating plate 341 opposite to the surface facing the blower chamber 331. The diameter of the reinforcing plate 70 is, for example, 11 mm and the thickness of the reinforcing plate 70 is, for example, 0.5 mm.

The piezoelectric element 42 is joined to a principal surface 340C of the reinforcing plate 70, opposite to the surface on which the blower chamber 331 is disposed. A joined body obtained by joining the piezoelectric element 42, the reinforcing plate 70, and the vibrating plate 341 together serves as a piezoelectric actuator 390.

In this embodiment, the vibrating plate 341 and the reinforcing plate 70 serves as a "vibrating plate" of the present disclosure. The principal surface 340C corresponds to a "second principal surface" of the present disclosure.

The housing 317 has a C-shaped cross section having an open bottom. The end of the housing 317 is joined to the vibrating plate 341. The housing 317 is made of a material such as a metal.

The housing 317 includes a disc-shaped top plate portion 318 opposing to the second principal surface 340B of the vibrating plate 341 and a ring-shaped side wall portion 19 that is continuous with the top plate portion 318. Part of the top plate portion 318 serves as a top surface of the blower chamber 331.

The top plate portion 318 has a column-shaped vent hole 24 that connects the blower chamber 331 to the outside of the blower chamber 331.

The top plate portion 318 includes a thick top portion 329 and a thin top portion 28 that is positioned on an inner-peripheral side of the thick top portion 329. The thin top portion 28 of the top plate portion 318 has a vent hole 24 that connects a central portion of the blower chamber 331 to the outside of the blower chamber 331. The thickness of the thick top portion 329 is, for example, 0.3 mm. The thickness of the thin top portion 28 is, for example, 0.05 mm.

The central portion of the blower chamber 331 is a portion that overlaps the piezoelectric element 42 when the first principal surface 340A of the vibrating plate 341 is viewed from the front.

A recessed portion 326 is formed in the top plate portion 318 on the side facing the vibrating plate 341. The recessed portion 326 defines a cavity 325, which constitutes the blower chamber 331 and communicates with a vent hole 24. The cavity 325 is column-shaped. The diameter of the cavity 325 is, for example, 3.0 mm, and the thickness of the cavity 325 is, for example, 0.25 mm.

Hereinbelow, the flow of air while the piezoelectric blower 300 is in operation is described.

FIG. 14 shows the relationship between pressure change at each point in the blower chamber 331 from a central axis C of the vibrating plate 341 to the outer periphery of the blower chamber 331 and displacement at each point on the vibrating plate 341 from the central axis C of the vibrating plate 341 to the outer periphery of the blower chamber 331, at a predetermined moment while the piezoelectric blower 300 illustrated in FIG. 13 is being driven. FIG. 14 is a graph obtained by simulation.

Here, in FIG. 14, the pressure change at each point in the blower chamber 331 and the displacement at each point on the vibrating plate 341 are indicated by values standardized on the basis of the displacement of the center of the vibrating plate 341 located on the central axis C of the vibrating plate 341. A pressure change distribution u(r) of the points in the blower chamber 331 shown in FIG. 14 is expressed by the formula $u(r)=J_0(k_0r/a)$, where the distance from the central axis C of the vibrating plate 341 is denoted by r.

When, in the state illustrated in FIG. 13, an alternating drive voltage with the third-order mode resonance frequency (fundamental) is applied to electrodes on two principal surfaces of the piezoelectric element 42, the piezoelectric element 42 expands and contracts and causes the vibrating plate 341 and the reinforcing plate 70 to concentrically bend and vibrate at the third-order mode resonance frequency f.

As in the case of the piezoelectric blower 100 illustrated in FIGS. 4A and 4B, the vibrating plate 341 is thus bent and deformed, so that the volume of the blower chamber 331 changes periodically.

The radius a of the blower chamber 331 and the resonance frequency f of the vibrating plate 341 satisfy the relationship of $0.8\times(k_0c)/(2\pi)\leq af\leq 1.2\times(k_0c)/(2\pi)$, where the acoustic velocity of air that passes through the blower chamber 331 is denoted by c and a value that satisfies the relationship obtained by differentiation of the Bessel function of the first kind of $J_0'(k_0)=0$ is denoted by $k_0$.

In this embodiment, the radius a of the blower chamber 331 is the shortest distance from the central axis C of the vibrating plate 341 to an end J of an area of the vibrating plate 341 located further inward from the joint portion at which the vibrating plate 341 is joined to the housing 317 since the space S interposed between the vibrating plate 341 and the housing 317 is not in contact with the openings having an opening ratio of 50% or higher. The resonance frequency f is 24.0 kHz. The acoustic velocity c of air is 340 m/s. $k_0$ is 3.83.

As shown by the dotted line in FIG. 14, each point on the vibrating plate 341 from the central axis C of the vibrating plate 341 to the outer periphery of the blower chamber 331 is displaced by vibration. As shown by the solid line in FIG. 14, from the central axis C of the blower chamber 331 to the outer periphery of the blower chamber 331, the pressure at each point in the blower chamber 331 changes due to the vibrating plate 341 being vibrated.

As shown by the dotted line and the solid line in FIG. 14, in the range from the central axis C of the vibrating plate 341 to the outer periphery of the blower chamber 331, the number of zero crossover points of the vibration displacement of the vibrating plate 341 is one, the number of zero crossover points of the pressure change in the blower chamber 331 is also one. Thus, the number of zero crossover points of the vibration displacement of the vibrating plate 341 is equal to the number of zero crossover points of the pressure change in the blower chamber 331.

Thus, in the piezoelectric blower 300, when the vibrating plate 341 vibrates, a distribution of the displacements of the respective points on the vibrating plate 341 approximates to the distribution of the pressure changes at the respective points in the blower chamber 331.

Here, when $af=(k_0c)/(2\pi)$, a node F of vibration of the vibrating plate 341 coincides with a node of pressure vibration of the blower chamber 331, and pressure resonance occurs. Further, even when the relationship of $0.8\times(k_0c)/(2\pi)\leq af\leq 1.2\times(k_0c)/(2\pi)$ is satisfied, the node of vibration of the vibrating plate 341 substantially coincides with the node of pressure vibration of the blower chamber 331.

The piezoelectric blower 300 is used for sucking a viscous liquid, such as nasal mucus or phlegm. In order to prevent the piezoelectric element from being broken as a result of long-time driving, the vibration speed of the piezoelectric element needs to be lower than or equal to 2 m/s. Since sucking nasal mucus or phlegm requires a pressure of 20 kPa or greater, the piezoelectric blower 300 requires a pressure amplitude of 10 kPa/(m/s) or greater.

When the relationship of $0.8\times(k_0c)/(2\pi)\leq af\leq 1.2\times(k_0c)/(2\pi)$ is satisfied, the piezoelectric blower 300 can obtain a pressure amplitude of 10 kPa/(m/s) or greater. Thus, when the relationship of $0.8\times(k_0c)/(2\pi)\leq af\leq 1.2\times(k_0c)/(2\pi)$ is satisfied, the piezoelectric blower 300 can produce high discharge pressure and high discharge flow rate usable to suck a viscous liquid, such as nasal mucus or phlegm.

Further, when the relationship of $0.9\times(k_0c)/(2\pi)\leq af\leq 1.1\times(k_0c)/(2\pi)$ is satisfied, the piezoelectric blower 300 can produce very high discharge pressure and very high discharge flow rate. The piezoelectric blower 300 has a cavity 325 near the vent hole 24 of the blower chamber 331. Thus, in the piezoelectric blower 300, a swirl that occurs near the vent hole 24 of the blower chamber 331 is weakened in the cavity 325. This configuration is thus capable of preventing pressure vibration in the blower chamber 331 from being disturbed by the swirl.

The piezoelectric blower 300 is thus capable of weakening a swirl occurring near the vent hole 24 of the blower chamber 331 and minimizing reduction of discharge pressure.

In the piezoelectric blower 300, when the vibrating plate 341 vibrates, the distribution of the displacements of the respective points on the vibrating plate 341 approximates to the distribution of the pressure changes at the respective points in the blower chamber 331. In other words, when the vibrating plate 341 vibrates, the points on the vibrating plate 341 are displaced in accordance with the pressure changes at the respective points in the blower chamber 331.

Thus, the piezoelectric blower 300 is capable of transmitting vibration energy of the vibrating plate 341 to the air in the blower chamber 331 without losing most of the vibration energy. Thus, the piezoelectric blower 300 is capable of producing high discharge pressure and high discharge flow rate.

Hereinbelow, the piezoelectric blower 300 according to the third embodiment of the present disclosure is compared to a piezoelectric blower 350 according to a comparative example provided for comparison with the third embodiment of the present disclosure.

FIG. 15 is a cross-sectional view of the piezoelectric blower 350 according to the comparative example provided for comparison with the third embodiment of the present disclosure. The piezoelectric blower 350 differs from the piezoelectric blower 300 in that the piezoelectric blower 350 has a cavity 325, communicating with the vent hole 24, on the side of a top plate portion 368 of a housing 367 opposite to the side on which the vibrating plate 41 is disposed. This cavity 325 does not constitute a blower chamber 381. Other points are the same as those in the piezoelectric blower 300 and thus are not described.

Now, measurement results of wind power (mN) of air flowing out from the vent hole 24 of the piezoelectric blower 350 and wind power (mN) of air flowing out from the vent hole 24 of the piezoelectric blower 300 are described below, the results being obtained under the conditions that a sinusoidal alternating-current voltage of 60 Vpp with a resonance frequency f (24.0 kHz) was applied to the piezoelectric blower 350 and the piezoelectric blower 300.

The experiments revealed that the piezoelectric blower 350 produces wind power of air of 1509.2 (mN) whereas the piezoelectric blower 300 produces wind power of air of 2469.6 (mN).

The reason why the above results are obtained is probably because, in the piezoelectric blower 300, a swirl occurring near the vent hole 24 of the blower chamber 331 is weakened in the cavity 325, so that the pressure vibration in the blower chamber 331 is successfully prevented from being disturbed by the swirl.

Thus, the piezoelectric blower 300 according to this embodiment is capable of weakening a swirl occurring near the vent hole 24 of the blower chamber 331 and minimizing reduction of discharge pressure.

In the third embodiment, a valve 80, which prevents gas from flowing into the blower chamber 331 from the outside through the vent hole 24, may be provided to the top plate portion 318 and an opening 324 having an opening ratio of 50% or lower may be formed in a portion of the vibrating plate 341 or the housing 317 (see FIG. 16). The opening 324 is column-shaped. The opening 324 is shaped in a circle when one principal surface of the top plate portion 318 is viewed from the front.

In the case, as illustrated in FIG. 16, where the valve 80 is disposed at the vent hole 24 of the housing 317, nonlinear pressure change occurs in the blower chamber 331 as a result of opening or closing of the valve 80. Thus, a swirl is more likely to occur near the vent hole 24 of the blower chamber 331. Thus, the cavity 325 is particularly effective in a piezoelectric blower 360 including the valve 80.

Fourth Embodiment of the Present Disclosure

A piezoelectric blower 400 according to a fourth embodiment of the present disclosure is described below.

FIG. 17 is a cross-sectional view of the piezoelectric blower 400 according to the fourth embodiment of the present disclosure. The piezoelectric blower 400 differs from the piezoelectric blower 300 in terms of the dimensions of the vibrating plate 441 and a housing 417. Other points are the same as those in the piezoelectric blower 300 and thus are not described.

In this embodiment, the blower chamber 431 is also column-shaped and a radius a of the blower chamber 431 is, for example, 10.3 mm. The vibrating plate 441 and the housing 417 are formed so that the blower chamber 431 has the radius a.

The vibrating plate 441 has a first principal surface 440A and a second principal surface 440B. A joined body obtained by joining a piezoelectric element 42, a reinforcing plate 70, and a vibrating plate 441 together serves as a piezoelectric actuator 490.

A recessed portion 326 is formed in a top plate portion 418 on the side facing the vibrating plate 441. The recessed portion 326 defines a cavity 325, which constitutes the blower chamber 331 and communicates with the vent hole 24.

Hereinbelow, the flow of air while the piezoelectric blower 400 is in operation is described.

FIG. 18 shows the relationship between pressure change at each point in the blower chamber 431 from a central axis C of the vibrating plate 441 to the outer periphery of the blower chamber 431 and displacement at each point on the vibrating plate 441 from the central axis C of the vibrating plate 441 to the outer periphery of the blower chamber 431, at a predetermined moment while the piezoelectric blower 400 illustrated in FIG. 17 is being driven. FIG. 18 is a graph obtained by simulation.

Here, in FIG. 18, the pressure change at each point in the blower chamber 431 and the displacement at each point on the vibrating plate 441 are indicated by values standardized on the basis of the displacement of the center of the vibrating plate 441 located on the central axis C of the vibrating plate 441. A pressure change distribution u(r) of the points in the blower chamber 431 shown in FIG. 18 is expressed by the formula $u(r)=J_0(k_0r/a)$, where the distance from the central axis C of the vibrating plate 441 is denoted by r.

When, in the state illustrated in FIG. 17, an alternating drive voltage with the third-order mode resonance frequency (fundamental) is applied to electrodes on two principal surfaces of the piezoelectric element 42, the piezoelectric element 42 expands and contracts and causes a vibrating plate 441 and the reinforcing plate 70 to concentrically bend and vibrate at the third-order mode resonance frequency f.

As in the case of the piezoelectric blower 100 illustrated in FIGS. 4A and 4B, the vibrating plate 441 is thus bent and deformed, so that the volume of the blower chamber 431 changes periodically.

The radius a of the blower chamber 431 and the resonance frequency f of the vibrating plate 441 satisfy the relationship of $0.8\times(k_0c)/(2\pi)\leq af\leq 1.2\times(k_0c)/(2\pi)$, where the acoustic velocity of air that passes through the blower chamber 431 is denoted by c and a value that satisfies the relationship obtained by differentiation of the Bessel function of the first kind of $J_0'(k_0)=0$ is denoted by $k_0$. In this embodiment, the resonance frequency f is 36.3 kHz. The acoustic velocity c of air is 340 m/s. $k_0$ is 7.02.

As shown by the dotted line in FIG. 18, each point on the vibrating plate 441 from the central axis C of the vibrating plate 441 to the outer periphery of the blower chamber 431 is displaced by vibration. As shown by the solid line in FIG. 18, from the central axis C of the vibrating plate 441 to the outer periphery of the blower chamber 431, the pressure at each point in the blower chamber 431 changes due to the vibrating plate 441 being vibrated.

As shown by the dotted line and the solid line in FIG. 18, in the range from the central axis C of the vibrating plate 441 to the outer periphery of the blower chamber 431, the number of zero crossover points of the vibration displacement of the vibrating plate 441 is two and the number of zero crossover points of the pressure change in the blower chamber 431 is also two. Thus, the number of zero crossover points of the vibration displacement of the vibrating plate 441 is equal to the number of zero crossover points of the pressure change in the blower chamber 431.

Thus, in the piezoelectric blower 400, when the vibrating plate 441 vibrates, a distribution of the displacements of the respective points on the vibrating plate 441 approximates to the distribution of the pressure changes at the respective points in the blower chamber 431.

Here, when $af=(k_0c)/(2\pi)$, a node of vibration of the vibrating plate 441 coincides with a node of pressure vibration of the blower chamber 431, and pressure resonance occurs. Further, even when the relationship of $0.8\times(k_0c)/(2\pi)\leq af\leq 1.2\times(k_0c)/(2\pi)$ is satisfied, the node of vibration of the vibrating plate 441 substantially coincides with the node of pressure vibration of the blower chamber 431.

The piezoelectric blower 400 is used for sucking a viscous liquid, such as nasal mucus or phlegm. In order to prevent the piezoelectric element from being broken as a result of long-time driving, the vibration speed of the piezoelectric element needs to be lower than or equal to 2 m/s. Since sucking nasal mucus or phlegm requires a pressure of 20 kPa or greater, the piezoelectric blower 400 requires a pressure amplitude of 10 kPa/(m/s) or greater.

When the relationship of $0.8\times(k_0c)/(2\pi)\leq af\leq 1.2\times(k_0c)/(2\pi)$ is satisfied, the piezoelectric blower 400 can obtain a pressure amplitude of 10 kPa/(m/s) or greater. Thus, when the relationship of $0.8\times(k_0c)/(2\pi)\leq af\leq 1.2\times(k_0c)/(2\pi)$ is satisfied, the piezoelectric blower 400 can produce high discharge pressure and high discharge flow rate usable to suck a viscous liquid, such as nasal mucus or phlegm.

Further, when the relationship of $0.9\times(k_0c)/(2\pi)\leq af\leq 1.1\times(k_0c)/(2\pi)$ is satisfied, the piezoelectric blower 400 can produce very high discharge pressure and very high discharge flow rate.

The piezoelectric blower 400 has a cavity 325 near the vent hole 24 of the blower chamber 431. Thus, in the piezoelectric blower 400, a swirl that occurs near the vent hole 24 of the blower chamber 431 is weakened in the cavity 325. This configuration is thus capable of preventing pressure vibration in the blower chamber 431 from being disturbed by the swirl.

The piezoelectric blower 400 is thus capable of weakening a swirl occurring near the vent hole 24 of the blower chamber 431 and minimizing reduction of discharge pressure.

In the piezoelectric blower 400, when the vibrating plate 441 vibrates, a distribution of displacements of the respective points on the vibrating plate 441 approximates to the distribution of the pressure changes at the respective points in the blower chamber 431. In other words, when the vibrating plate 441 vibrates, the points on the vibrating plate 441 are displaced in accordance with the pressure changes at the respective points in the blower chamber 431.

Therefore, the piezoelectric blower 400 is capable of transmitting vibration energy of the vibrating plate 441 to the air in the blower chamber 431 without losing most of the vibration energy. Thus, the piezoelectric blower 400 is capable of producing high discharge pressure and high discharge flow rate.

Thus, the piezoelectric blower 400 according to the fourth embodiment has the same advantages as the piezoelectric blower 300 according to the third embodiment.

Hereinbelow, the piezoelectric blower 400 according to the fourth embodiment of the present disclosure is compared to a piezoelectric blower 450 according to a comparative example provided for comparison with the fourth embodiment of the present disclosure.

FIG. 19 is a cross-sectional view of the piezoelectric blower 450 according to the comparative example provided for comparison with the fourth embodiment of the present disclosure. The piezoelectric blower 450 differs from the piezoelectric blower 400 in that the piezoelectric blower 450 has a cavity 325, communicating with a vent hole 24, on the side of a top plate portion 468 of a housing 467 opposite to the side facing the vibrating plate 41. This cavity 325 does not constitute a blower chamber 481. Other points are the same as those in the piezoelectric blower 400 and thus are not described.

Now, measurement results of wind power (mN) of air flowing out from the vent hole 24 of the piezoelectric blower 450 and wind power (mN) of air flowing out from the vent hole 24 of the piezoelectric blower 400 are described below, the results being obtained under the conditions that a sinusoidal alternating-current voltage of 30 Vpp with a resonance frequency f (36.3 kHz) was applied to the piezoelectric blower 450 and the piezoelectric blower 400.

The experiments revealed that the piezoelectric blower 450 produces wind power of air of 823.2 (mN) whereas the piezoelectric blower 400 produces wind power of air of 1244.6 (mN).

The reason why the above results are obtained is probably because, in the piezoelectric blower 400, a swirl occurring near the vent hole 24 of the blower chamber 431 is weakened in the cavity 325, so that the pressure vibration in the blower chamber 431 is successfully prevented from being disturbed by the swirl.

Thus, the piezoelectric blower 400 according to this embodiment is capable of weakening a swirl occurring near the vent hole 24 of the blower chamber 431 and minimizing reduction of discharge pressure.

In the fourth embodiment, a valve 80, which prevents gas from flowing into the blower chamber 431 from the outside through the vent hole 24, may be provided to the top plate portion 418 and an opening 424 having an opening ratio of 50% or lower may be formed in a portion of the vibrating plate 441 or the housing 417 (see FIG. 20). The openings 424 are column-shaped. The openings 424 are shaped in a circle when one principal surface of the vibrating plate 441 is viewed from the front. When one principal surface of the vibrating plate 41 is viewed from the front, each opening has a shape of a fan having an arc 62A as illustrated in FIG. 2. When all the openings 62 are connected together, the openings 62 form a ring shape.

In the case, as illustrated in FIG. 20, where the valve 80 is disposed at the vent hole 24 of the housing 417, nonlinear pressure change occurs in the blower chamber 431 as a result of opening or closing of the valve 80. Thus, a swirl is more likely to occur near the vent hole 24 of the blower chamber 431. Thus, the cavity 325 is particularly effective in a piezoelectric blower 460 including the valve 80.

Other Embodiments

Although, in the above-described embodiments, air is used as the fluid, the present disclosure is not limited to this configuration. The present disclosure is also applicable to the case where the fluid is gas other than air.

Although, in the above-described embodiments, the vibrating plates 41, 241, 341, and 441 and the reinforcing plate 70 are made of SUS, the present disclosure is not limited to this configuration. The vibrating plates 41, 241, 341, and 441 and the reinforcing plate 70 may be made of other materials, such as aluminum, titanium, magnesium, or copper.

Although, in the above-described embodiments, the piezoelectric element 42 is provided as a driving source of the blower, the present disclosure is not limited to this configuration. For example, a blower of the disclosure may be formed as a blower that performs pumping by electromagnetic driving.

Although, in the above-described embodiments, the piezoelectric element 42 is made of a lead zirconate titanate ceramic, the present disclosure is not limited to this configuration. For example, the piezoelectric element 42 may be made of piezoelectric materials of a non-lead piezoelectric ceramic such as a potassium sodium niobate-based ceramic or an alkali niobate-based ceramic.

In the first embodiment, the piezoelectric element 42 is joined to the first principal surface 40A of the vibrating plate 41 on the side opposite to the surface facing the blower chamber 31. However, the present disclosure is not limited to this configuration. In practice, for example, the piezoelectric element 42 may be joined to the second principal surface 40B of the vibrating plate 41 facing the blower chamber 31 or two piezoelectric elements 42 may be respectively joined to the first principal surface 40A and the second principal surface 40B of the vibrating plate 41. In this case, the housing 17 defines a blower chamber together with a piezoelectric actuator, including at least one piezoelectric element 42 and the vibrating plate 41, such that the blower chamber is interposed between the housing 17 and the piezoelectric actuator in a thickness direction of the vibrating plate 41.

Although, in the second embodiment, the piezoelectric element 42 is joined to the principal surface 240C of the reinforcing plate 70 opposite to the surface on which the blower chamber 231 is disposed, the present disclosure is not limited to this configuration, either. In practice, for example, the piezoelectric element 42 may be joined to the second principal surface 240B of the vibrating plate 241 on the side on which the blower chamber 231 is disposed or two piezoelectric elements 42 may be respectively joined to the principal surface 240C of the reinforcing plate 70 and the second principal surface 240B of the vibrating plate 241. In this case, the housing 217 defines a blower chamber together with a piezoelectric actuator, including at least one piezoelectric element 42 and the vibrating plate 241, such that the blower chamber is interposed between the housing 217 and the piezoelectric actuator in a thickness direction of the vibrating plate 241.

Although, in the third embodiment, the piezoelectric element 42 is joined to the principal surface 340C of the reinforcing plate 70 opposite to the surface on which the blower chamber 331 is disposed, the present disclosure is not limited to this configuration, either. In practice, for example, the piezoelectric element 42 may be joined to the second principal surface 340B of the vibrating plate 341 or two piezoelectric elements 42 may be respectively joined to the principal surface 340C of the reinforcing plate 70 and the second principal surface 340B of the vibrating plate 341. In this case, the housing 317 defines a blower chamber together with a piezoelectric actuator, including at least one piezoelectric element 42, the reinforcing plate 70, and the vibrating plate 341, such that the blower chamber is interposed between the housing 317 and the piezoelectric actuator in a thickness direction of the vibrating plate 341.

Although, in the fourth embodiment, the piezoelectric element 42 is joined to a principal surface 440C of the reinforcing plate 70 opposite to the surface on which the blower chamber 431 is disposed, the present disclosure is not limited to this configuration, either. In practice, for example, the piezoelectric element 42 may be joined to the second principal surface 440B of the vibrating plate 441 or two piezoelectric elements 42 may be respectively joined to the principal surface 440C of the reinforcing plate 70 and the second principal surface 440B of the vibrating plate 441. In this case, the housing 417 defines a blower chamber together with a piezoelectric actuator, including at least one piezoelectric element 42, the reinforcing plate 70, and the vibrating plate 441, such that the blower chamber is interposed between the housing 417 and the piezoelectric actuator in a thickness direction of the vibrating plate 441.

Although, in the above-described embodiments, the disc-shaped piezoelectric element 42, the disc-shaped vibrating plate 41, the disc-shaped reinforcing plate 70, the disc-shaped top plate portion 18, and other components having particular shapes are used, the present disclosure is not limited to this configuration. For example, they may have a rectangular or a polygonal shape.

Although, in the above-described embodiments, $k_0$ is 2.40, 3.83, 5.52, or 7.02, the present disclosure is not limited to this configuration. $k_0$ may be any value that satisfies the relationship of $J_0(k_0)=0$ or $J_0'(k_0)=0$, such as 8.65, 10.17, 11.79, 13.32, or 14.93.

Although, in the above-described embodiments, the vibrating plate of the piezoelectric blower is bent and vibrated at a frequency such as the first-order mode frequency or the third-order mode frequency, the present disclosure is not limited to this configuration. In practice, the vibrating plate may be bent and vibrated in a vibration mode of a third-order mode or a higher odd-order mode producing multiple vibration antinodes.

Although, in the above-described embodiments, the blower chambers 31, 231, 331, and 431 are column-shaped, the present disclosure is not limited to this configuration. In practice, the blower chambers may have the shape of a regular prism. In this case, instead of using the radius a of the blower chamber, the shortest distance a from the central axis of the vibrating plate to the outer periphery of the blower chamber is used.

Although, in the above-described embodiments, the top plate portion 18, 218, 318, or 418 includes one circular vent hole 24, the present disclosure is not limited to this configuration. In practice, for example, as shown in FIGS. 21 to 23, multiple vent holes 524, 624, or 724 may be provided. For example, as with vent holes 624 to 824 illustrated in FIGS. 22 to 24, the vent hole or holes need not be circular.

In the above-described embodiments, a column-shaped cavity 25, 225, or 325 is formed in the corresponding top plate portion 18, 218, 318, or 418 by forming the corresponding recessed portion 26, 226, or 326. However, the present disclosure is not limited to this configuration. In practice, a cavity may be formed by, for example, forming a rounded recessed portion 526 as illustrated in FIG. 25, forming a tapered recessed portion 626 or 726 as illustrated in FIG. 26 or FIG. 27, or forming a polygonal two-tier recessed portion 826 or 926 as illustrated in FIG. 28 or FIG. 29.

Although, in the above-described embodiments, the openings 62 are formed in the vibrating plate 41 and the openings 262 are formed in the vibrating plate 241, the present disclosure is not limited to this configuration. In practice, the openings may be formed in the top plate portion or the side wall portion of the housing.

In the above-described embodiment, the vent hole 24 is formed in the housing 17, 217, 317, or 417. However, the present disclosure is not limited to this configuration. In practice, the vent hole may be formed in the vibrating plate.

Although, in the above-described embodiments, the recessed portion 26, 226, or 326 is formed in the corresponding housing 17, 217, 317, or 417, the present disclosure is not limited to this configuration, either. In practice, the recessed portion may be formed in the vibrating plate.

Lastly, the description of the above-described embodiments is to be considered in all respects only as illustrative and not restrictive. The scope of the present disclosure is indicated by the claims rather than by the above-described embodiments. Further, the scope of the present disclosure embraces all changes that come within the meaning and range within the equivalency of the claims.

a radius
C central axis
F node
17 housing
18 top plate portion
19 side wall portion

24 vent hole
25 cavity
26 recessed portion
28 thin top portion
29 thick top portion
31 blower chamber
34 outer peripheral portion
35 beam portion
36 vibrating portion
40A first principal surface
40B second principal surface
41 vibrating plate
42 piezoelectric element
62 opening
70 reinforcing plate
80 valve
90 piezoelectric actuator
100, 150, 160 piezoelectric blower
167 housing
168 top plate portion
181 blower chamber
200 piezoelectric blower
217 housing
218 top plate portion
225 cavity
226 recessed portion
229 thick top portion
231 blower chamber
240A first principal surface
240B second principal surface
240C principal surface
241 vibrating plate
250, 260 piezoelectric blower
262 opening
267 housing
268 top plate portion
281 blower chamber
290 piezoelectric actuator
300 piezoelectric blower
317 housing
318 top plate portion
324 opening
325 cavity
326 recessed portion
329 thick top portion
331 blower chamber
340A first principal surface
340B second principal surface
340C principal surface
341 vibrating plate
350, 360 piezoelectric blower
367 housing
368 top plate portion
381 blower chamber
390 piezoelectric actuator
400 piezoelectric blower
417 housing
418 top plate portion
424 opening
431 blower chamber
440A first principal surface
440B second principal surface
440C principal surface
441 vibrating plate
450, 460 piezoelectric blower
467 housing
468 top plate portion
481 blower chamber
490 piezoelectric actuator
517 housing
524 vent hole
617 housing
624 vent hole
717 housing
724 vent hole
817 housing
824 vent hole

The invention claimed is:

1. A blower comprising:

an actuator including a vibrating plate and a driving member, the vibrating plate including a first principal surface and a second principal surface, the driving member being disposed on at least one of the first principal surface and the second principal surface of the vibrating plate, the driving member causing the vibrating plate to concentrically bend and vibrate; and a housing joined to the vibrating plate to form a blower chamber together with the actuator, wherein at least one of the vibrating plate and the housing includes a vent hole and a recessed portion, the vent hole connecting a center portion of the blower chamber to an outside of the blower chamber, the recessed portion constituting a portion of the blower chamber and defining a communication space communicating with the vent hole, and wherein a shortest distance a from a central axis of the blower chamber to an outer periphery of the blower chamber and a resonance frequency f of the vibrating plate satisfy a relationship of $0.8\times(k_0c)/(2\pi)\leq af\leq 1.2\times(k_0c)/(2\pi)$, where an acoustic velocity of gas passing through the blower chamber is denoted by c and a value satisfying a relationship of a Bessel function of a first kind of $J_0(k_0)=0$ or $J_0'(k_0)=0$ is denoted by $k_0$.

2. The blower according to claim 1, wherein when a space interposed between the vibrating plate and the housing is in contact with an opening having an opening ratio of 50% or higher:

the opening is located in at least one of the vibrating plate and the housing, and a shortest distance a from a central axis of the vibrating plate to an end of an area of the vibrating plate, the area being located further inward from the opening when the first principal surface is viewed from front, and the resonance frequency f of the vibrating plate satisfy the relationship of $0.8\times(k_0c)/(2\pi)\leq af\leq 1.2\times(k_0c)/(2\pi)$, where an acoustic velocity of gas passing through the blower chamber is denoted by c and a value satisfying the relationship of the Bessel function of the first kind of $J_0(k_0)=0$ is denoted by $k_0$.

3. The blower according to claim 1, wherein when a space interposed between the vibrating plate and the housing is not in contact with an opening having an opening ratio of 50% or higher:

a shortest distance a from a central axis of the vibrating plate to an end of an area of the vibrating plate, the area being located further inward from a joint portion at which the vibrating plate is joined to the housing, and the resonance frequency f of the vibrating plate satisfy the relationship of $0.8\times(k_0c)/(2\pi)\leq af\leq 1.2\times(k_0c)/(2\pi)$, where an acoustic velocity of gas passing through the blower chamber is denoted by c and a value satisfying the relationship of the Bessel function of the first kind of $J_0'(k_0)=0$ is denoted by $k_0$.

4. The blower according to claim 1, wherein the vent hole is located in the housing.

5. The blower according to claim 1, wherein the vent hole is provided with a valve preventing the gas from flowing into the blower chamber from the outside of the blower chamber.

6. The blower according to claim 1, wherein each of the points on the vibrating plate within an area from the central axis of the vibrating plate to the outer periphery of the blower chamber is displaced by a vibration, wherein, from the central axis of the vibrating plate to the outer periphery of the blower chamber, a pressure at each of the points in the blower chamber changes due to the vibrating plate being vibrated, and wherein, in a range from the central axis of the vibrating plate to the outer periphery of the blower chamber, a number of zero crossover points of the vibration displacement of the vibrating plate is equal to a number of zero crossover points of pressure change of the blower chamber.

7. The blower according to claim 1, wherein the driving member is a piezoelectric member.

8. The blower according to claim 2, wherein the vent hole is located in the housing.

9. The blower according to claim 3, wherein the vent hole is located in the housing.

10. The blower according to claim 2, wherein the vent hole is provided with a valve preventing the gas from flowing into the blower chamber from the outside of the blower chamber.

11. The blower according to claim 3, wherein the vent hole is provided with a valve preventing the gas from flowing into the blower chamber from the outside of the blower chamber.

12. The blower according to claim 4, wherein the vent hole is provided with a valve preventing the gas from flowing into the blower chamber from the outside of the blower chamber.

13. The blower according to claim 2, wherein each of the points on the vibrating plate within an area from the central axis of the vibrating plate to the outer periphery of the blower chamber is displaced by a vibration, wherein, from the central axis of the vibrating plate to the outer periphery of the blower chamber, a pressure at each of the points in the blower chamber changes due to the vibrating plate being vibrated, and wherein, in a range from the central axis of the vibrating plate to the outer periphery of the blower chamber, a number of zero crossover points of the vibration displacement of the vibrating plate is equal to a number of zero crossover points of pressure change of the blower chamber.

14. The blower according to claim 3, wherein each of the points on the vibrating plate within an area from the central axis of the vibrating plate to the outer periphery of the blower chamber is displaced by a vibration, wherein, from the central axis of the vibrating plate to the outer periphery of the blower chamber, a pressure at each of the points in the blower chamber changes due to the vibrating plate being vibrated, and wherein, in a range from the central axis of the vibrating plate to the outer periphery of the blower chamber, a number of zero crossover points of the vibration displacement of the vibrating plate is equal to a number of zero crossover points of pressure change of the blower chamber.

15. The blower according to claim 4, wherein each of the points on the vibrating plate within an area from the central axis of the vibrating plate to the outer periphery of the blower chamber is displaced by a vibration, wherein, from the central axis of the vibrating plate to the outer periphery of the blower chamber, a pressure at each of the points in the blower chamber changes due to the vibrating plate being vibrated, and wherein, in a range from the central axis of the vibrating plate to the outer periphery of the blower chamber, a number of zero crossover points of the vibration displacement of the vibrating plate is equal to a number of zero crossover points of pressure change of the blower chamber.

16. The blower according to claim 5, wherein each of the points on the vibrating plate within an area from the central axis of the vibrating plate to the outer periphery of the blower chamber is displaced by a vibration, wherein, from the central axis of the vibrating plate to the outer periphery of the blower chamber, a pressure at each of the points in the blower chamber changes due to the vibrating plate being vibrated, and wherein, in a range from the central axis of the vibrating plate to the outer periphery of the blower chamber, a number of zero crossover points of the vibration displacement of the vibrating plate is equal to a number of zero crossover points of pressure change of the blower chamber.

17. The blower according to claim 2, wherein the driving member is a piezoelectric member.

18. The blower according to claim 3, wherein the driving member is a piezoelectric member.

19. The blower according to claim 4, wherein the driving member is a piezoelectric member.

20. The blower according to claim 5, wherein the driving member is a piezoelectric member.

21. A blower comprising:

an actuator including a vibrating plate and a driving member, the vibrating plate including a first principal surface and a second principal surface, the driving member being disposed on at least one of the first principal surface and the second principal surface of the vibrating plate, the driving member causing the vibrating plate to concentrically bend and vibrate; and a housing joined to the vibrating plate to form a blower chamber together with the actuator, wherein the housing includes a vent hole and a recessed portion, the vent hole connecting a center portion of the blower chamber to an outside of the blower chamber, the recessed portion constituting a portion of the blower chamber and defining a communication space communicating with the vent hole, wherein a shortest distance a from a central axis of the blower chamber to an outer periphery of the blower chamber and a resonance frequency f of the vibrating plate satisfy a relationship of $0.8\times(k_0c)/(2\pi)\leq af\leq 1.2\times(k_0c)/(2\pi)$, where an acoustic velocity of gas passing through the blower chamber is denoted by c and a value satisfying a relationship of a Bessel function of a first kind of $J_0(k_0)=0$ or $J_0'(k_0)=0$ is denoted by $k_0$, and wherein the vibrating plate does not include any vent hole connecting the center portion of the blower chamber to the outside of the blower chamber.

* * * * *